US011490679B2

(12) United States Patent
Maselino et al.

(10) Patent No.: US 11,490,679 B2
(45) Date of Patent: Nov. 8, 2022

(54) FOOT SUPPORT COMPONENTS FOR ARTICLES OF FOOTWEAR

(71) Applicant: NIKE, Inc., Beaverton, OR (US)

(72) Inventors: Gabriel T. Maselino, Portland, OR (US); Alexander Stephens, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 201 days.

(21) Appl. No.: 17/031,405

(22) Filed: Sep. 24, 2020

(65) Prior Publication Data

US 2021/0085019 A1 Mar. 25, 2021

Related U.S. Application Data

(60) Provisional application No. 62/905,649, filed on Sep. 25, 2019.

(51) Int. Cl.

| | |
|---|---|
| ***A43B 7/14*** | (2022.01) |
| ***A43B 13/18*** | (2006.01) |
| ***A43B 21/32*** | (2006.01) |

(52) U.S. Cl.

CPC ..... *A43B 7/14* (2013.01); *A43B 13/181* (2013.01); *A43B 21/32* (2013.01)

(58) Field of Classification Search

CPC ..... A43B 7/14; A43B 21/32; A43B 13/181; A43B 13/186

USPC ..... 36/27, 28, 37, 35 R

See application file for complete search history.

(56) References Cited

U.S. PATENT DOCUMENTS

| | | | |
|---|---|---|---|
| 4,878,300 | A | 11/1989 | Bogaty |
| 5,280,680 | A | 1/1994 | Burke et al. |
| 5,337,492 | A | 8/1994 | Anderie et al. |
| 5,572,804 | A | 11/1996 | Skaja et al. |
| 5,651,196 | A | 7/1997 | Hsieh |
| 5,720,118 | A | 2/1998 | Mayer et al. |
| 6,298,582 | B1 | 10/2001 | Friton et al. |

(Continued)

FOREIGN PATENT DOCUMENTS

| | | |
|---|---|---|
| EP | 0122985 B1 | 2/1987 |
| FR | 2774566 B1 | 5/2000 |

(Continued)

OTHER PUBLICATIONS

Zamosky, "Shoe Modifications in Lower-Extremity Orthotics," published at rehad.research.va.gov, Aug. 13, 2012.

Nov. 24, 2020—(WO) ISR & WO—App. No. PCT/US20/052673.

*Primary Examiner* — Marie D Bays

(74) *Attorney, Agent, or Firm* — Banner & Witcoff, Ltd.

(57) ABSTRACT

Foot support components include plural foot support members (e.g., arched slats or other support members) forming at least a portion of a footbed for a sole structure/article of footwear. Spacings between individual foot support members enable selective activation of one or more individual members, thereby providing support where needed and enhancing overall comfort without overly stiffening the footbed. When made from sufficiently rigid/resilient materials, the foot support components may apply return energy to the wearer's foot. This may occur, for example, by vertically deflecting (e.g., flattening out) one or more foot support members under applied force, and then the deflected foot support member(s) will spring back to and/or toward its/their original shape when the force sufficiently abates/relaxes.

20 Claims, 14 Drawing Sheets

(56) References Cited

U.S. PATENT DOCUMENTS

| | | | | |
|---|---|---|---|---|
| 6,516,539 | B2 | 2/2003 | Nishiwaki et al. | |
| 7,013,581 | B2 | 3/2006 | Greene et al. | |
| 7,162,815 | B2 | 1/2007 | Miyauchi et al. | |
| 7,383,647 | B2 | 6/2008 | Chan et al. | |
| 7,421,805 | B2 | 9/2008 | Geer | |
| 7,937,854 | B2 | 5/2011 | Kilgore | |
| 7,987,618 | B2 | 8/2011 | Nishiwaki et al. | |
| 8,056,261 | B2 | 11/2011 | Nakano et al. | |
| 8,166,671 | B2 * | 5/2012 | Frederick | A43B 13/183 36/35 R |
| 8,621,767 | B2 | 1/2014 | Vestuti et al. | |
| 8,635,785 | B2 * | 1/2014 | Seo | A43B 13/127 36/27 |
| 9,578,920 | B2 | 2/2017 | Grott et al. | |
| 9,750,300 | B2 | 9/2017 | Peyton et al. | |
| 9,930,927 | B2 | 4/2018 | Luedecke et al. | |
| 9,968,160 | B2 | 5/2018 | Peyton | |
| 10,251,445 | B2 | 4/2019 | McDonald | |
| 2005/0039347 | A1 * | 2/2005 | Meschan | A43B 13/206 36/35 B |
| 2005/0132610 | A1 | 6/2005 | Foxen et al. | |
| 2008/0201984 | A1 * | 8/2008 | Dojan | A43B 13/146 36/35 B |
| 2009/0139114 | A1 | 6/2009 | Malek | |
| 2009/0145004 | A1 | 6/2009 | Jones | |
| 2009/0229143 | A1 * | 9/2009 | Meschan | A43B 21/26 36/35 R |
| 2010/0236096 | A1 * | 9/2010 | Pauk | A43B 13/125 36/28 |
| 2011/0277355 | A1 | 11/2011 | Fahmi et al. | |
| 2014/0259746 | A1 | 9/2014 | Abshire et al. | |
| 2015/0013185 | A1 * | 1/2015 | Elder | A43B 13/184 36/83 |
| 2016/0338446 | A1 * | 11/2016 | Merlo | A43B 13/186 |
| 2017/0000213 | A1 * | 1/2017 | Mason | A43B 13/187 |
| 2017/0251750 | A1 * | 9/2017 | Devoe | A43B 7/1495 |
| 2018/0125148 | A1 | 5/2018 | Elder et al. | |
| 2020/0305549 | A1 * | 10/2020 | Bailly | A43B 7/144 |
| 2021/0361027 | A1 * | 11/2021 | Durflinger | A43B 13/145 |
| 2021/0368918 | A1 * | 12/2021 | Lyke | A43B 13/20 |

FOREIGN PATENT DOCUMENTS

| | | | |
|---|---|---|---|
| KR | 101483775 | B1 | 1/2015 |
| WO | 9935928 | A1 | 7/1999 |
| WO | 2007069069 | A2 | 6/2007 |
| WO | 2007069069 | A3 | 10/2007 |

* cited by examiner

FOOT SUPPORT COMPONENTS FOR ARTICLES OF FOOTWEAR

RELATED APPLICATION DATA

This application claims priority benefits to and is a U.S. Non-Provisional patent application based on U.S. Provisional Patent Appln. No. 62/905,649 filed Sep. 25, 2019. U.S. Provisional Patent Appln. No. 62/905,649 is entirely incorporated herein by reference.

FIELD OF THE INVENTION

The present technology relates to the field of footwear. More specifically, aspects of the present technology pertain to foot support components for articles of footwear.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and any contact surface. In addition to attenuating ground reaction forces and absorbing energy, the sole structure may provide traction and control potentially harmful foot motion, such as over pronation. General features and configurations of uppers and sole structures are discussed in greater detail below.

The upper forms a void on the interior of the footwear for receiving the foot. The void has the general shape of the foot, and access to the void is provided at an ankle or foot-insertion opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture. The midsole, which is traditionally attached to the upper along the upper's entire length, forms the middle layer of the sole structure and serves a variety of purposes that include controlling foot motions and attenuating impact forces. The outsole forms the ground-contacting element of footwear and usually is fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, the degree of ground reaction force attenuation, and the energy absorption properties may be altered to meet the specific demands of the activity for which the footwear is intended to be used.

Terminology

Some general terminology and information is provided that will assist in understanding various portions of this specification and the invention(s) as described herein. As noted above, the present technology relates to the field of footwear, but it also may relate to other foot-receiving devices. "Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include: (a) one or more "foot-covering members" (e.g., akin to footwear upper components), which help position the foot with respect to other components or structures and (b) one or more "foot-supporting members" or foot-support components" (e.g., akin to footwear sole structures and components thereof), which support at least some portion(s) of a plantar surface of a user's foot. "Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, track shoes, track field event shoes (e.g., for high jump, triple jump, etc.), etc.), and the like. "Foot-supporting members" may include components for and/or functioning as midsoles and/or outsoles for articles of footwear (or components providing corresponding functions in non-footwear type foot-receiving devices).

FIG. 1A also provides information that may be useful for explaining and understanding the specification and/or aspects of this technology. FIG. 1A provides a representation of a footwear/foot-receiving device component 100, which in this illustrated example constitutes a portion of a sole structure for an article of footwear. The same general definitions and terminology described below may apply to footwear and foot-receiving devices in general and/or to other footwear/foot-receiving device components or portions thereof, such as an upper, a midsole component, an outsole component, a sole structure, etc.

First, as illustrated in FIG. 1A, the terms "forward" or "forward direction" as used herein, unless otherwise noted or clear from the context, mean toward or in a direction toward a forward-most toe area FT of the footwear or foot-receiving device structure or component 100. The terms "rearward" or "rearward direction" as used herein, unless otherwise noted or clear from the context, mean toward or in a direction toward a rear-most heel area RH of the footwear or foot-receiving device structure or component 100. The terms "lateral" or "lateral side" as used herein, unless otherwise noted or clear from the context, mean the outside or "little toe" side of the footwear or foot-receiving device structure or component 100. The terms "medial" or "medial side" as used herein, unless otherwise noted or clear from the context, mean the inside or "big toe" side of the footwear or foot-receiving device structure or component 100.

Also, various example features and aspects of this technology are disclosed or explained herein with reference to a "longitudinal direction" and/or with respect to a "longitudinal length" L of a footwear/foot-receiving device component 100 (such as a footwear sole structure). As shown in FIG. 1A, the "longitudinal direction" is determined as the direction of a line extending from a rearmost heel location (RH in FIG. 1A) to the forwardmost toe location (FT in FIG. 1A) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight applied to it other than potentially the weight of the shoe/foot-receiving device components with which it is engaged). If the forwardmost and/or rearmost locations of a specific footwear or foot-receiving device component 100 constitute a line segment (rather than a tangent point), then the forwardmost toe location and/or the rearmost heel location constitute the mid-point of the corresponding line segment. If the forwardmost and/or rearmost locations of a specific footwear or foot-receiving device component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 1A). The locations of these perpendicular planes may be specified based on their positions along the longitudinal length L where the perpendicular plane intersects the longitudinal direction between the rearmost heel location RH and the forwardmost toe location FT. In this illustrated example of FIG. 1A, the rearmost heel location RH is considered as the origin for measurements (or the "0L position") and the forwardmost toe location FT is considered the end of the longitudinal length L of this component (or the "1.0L position"). Plane position may be specified based on its location along the longitudinal length L (between 0L and 1.0L), measured forward from the rearmost heel RH location in this example. FIG. 1A further shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1A, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1A. The "transverse direction" shown in FIG. 1A also is perpendicular to the longitudinal direction (and optionally, in at least some instances, may extend along the direction of the horizontal surface S).

The term "slat," as used herein, unless otherwise defined or clear from the context, means a thin, narrow strip of a foot support component extending across and forming a portion of a base support surface of the foot support component. In at least some examples, a "slat" will have a thickness dimension "T" (e.g., in a foot support component/footwear top-to-bottom direction), a width dimension "W" (e.g., a direct dimension across the component from one open space to an opposite and adjacent open space—in some examples, a dimension in the foot support component's heel-to-toe direction and/or in the sole structure's/footwear's longitudinal direction), and a breadth dimension "B" (e.g., transverse to the width dimension—in some examples, a dimension in the foot support component's lateral side-to-medial side direction and/or in the sole structure's/footwear's transverse direction). In some examples of this technology, a "slat" may have any one or more of the following features: (a) T=0.01W to 0.6W; (b) T=0.025W to 0.5W; (c) T=0.05W to 0.45W; (d) T=0.075W to 0.35W; (e) W=0.01B to 0.4B; (f) W=0.02B to 0.35B; (g) W=0.03B to 0.3B; and/or (h) W=0.05B to 0.25B. While "slats" may have a generally rectangular shape or may be formed as a rectangular prism, "slats" as that term is used herein may have one or more rounded corners and/or edges. "Slats" also may have curved edges in any dimension (including curved edges in one or more of the thickness direction, the width direction, and/or the breadth dimension).

The term "extrema" as used herein, unless otherwise defined or clear from the context, means a point of inflection of a curved or arched surface. With respect to foot support members and/or slats as described herein, an "extrema" corresponds to the peak of the curved surface when the foot support member, sole structure, and/or article of footwear is supported on its ground-facing surface on a horizontal support surface, e.g., in an unloaded condition (e.g., with no external forces applied thereto except for forces holding the foot support member, sole structure, and/or article of footwear together).

The term "central area" of a foot support member or slat, as used herein, unless otherwise defined or clear from the context, means a central 35% to 65% of the foot support member or slat in its longest dimension B (e.g., in some examples, this longest dimension of the member/slat will be a breadth dimension and/or in the lateral side-to-medial side direction of the foot support member or slat). If a foot support member or slat is considered to have a longest dimension B in one direction (e.g., from its lateral end point to its medial end point), the "central 35% to 65%" or "central area" of that foot support member or slat means the region located from 0.35B to 0.65B measured from either side's origin point. See the shaded area of FIG. 1B.

The phrase "originates at or proximate to" as used herein, unless otherwise noted or clear from the context, means the location of the opening or open space defining an outer extreme of a foot support member/slat in the breadth dimension B (the outer point of the opening or open space that defines an edge of the foot support member/slat) directly at or within 20 mm of any portion of the corresponding sidewall of the component. In some examples, the foot support member/slat will originate (have an "origination point") within 15 mm, within 10 mm, or even within 5 mm, of the corresponding sidewall. Foot support members/slats defined by openings or open spaces that originate within the sidewall fall within the scope of the term "originate at or proximate to," unless the phrase is further modified to expressly state that the foot support member/slat originates in the base support surface. The phrase "located at or proximate to" similarly means that any portions of the noted items (e.g., an "origination point" and a "sidewall") are within 20 mm of one another (and in some examples, when stated, may be within 15 mm, within 10 mm, within 5 mm, or even contacting).

The term "spaced away" as used herein, unless otherwise noted or clear from the context, means that at least some measurable distance exists between the noted components. In some more specific examples, if specifically noted, a foot support member/slat may originate (have an "origination point") at a location "spaced away" from a free edge of a sidewall by a direct distance of at least 2 mm, and in some examples, by at least 3 mm, at least 5 mm, at least 10 mm, or even at least 15 mm Additionally or alternatively, in at least some examples, a distance or dimension (e.g., a sidewall height dimension or other direct distance measurement) of at least 2 mm (and in some examples, at least 3 mm, at least 5 mm, at least 10 mm, or even at least 15 mm) may exist between: (a) an outer extreme of a foot support member/slat in the breadth dimension B (the outer point of the opening or open space defining an edge of the foot support member/slat) and (b) the free (e.g., top) edge of the corresponding sidewall.

The term "substantially parallel" as used herein, unless otherwise noted or clear from the context, means that the two items (e.g., two edges of foot support members/slats, two edges of an opening defining foot support members/slats, etc.): (a) are parallel (i.e., are separated by a constant distance), (b) are separated by a "substantially constant distance "d" (i.e., d±10%) over at least 85% of at least one of the item's dimension (e.g., at least one edge's breadth dimension), and/or (c) extend in directions (e.g., breadth dimension directions) that do not intersect (e.g., within the base support surface) and are at an angle of less than 10 degree from one another. Edges that directly intersect one another (e.g., within the base support surface) are not "substantially parallel" irrespective of their angles with respect to one another. Edges need not be straight lines to be "substantially parallel."

The term "majority" as used herein, means any amount "more than 50%." The phrase "foot support member/slat" as used herein (including its plural variation) means "foot support member and/or slat."

SUMMARY OF THE INVENTION

Foot support components include plural arched foot support members (e.g., arched slats) forming at least a portion of a footbed for a sole structure/article of footwear. Spacings between individual foot support members enable selective activation of one or more individual members, thereby providing support where needed and enhancing overall comfort without overly stiffening the footbed. When made from sufficiently rigid/resilient materials, the foot support components may bend (e.g., flatten) under an applied force and then apply return energy to the wearer's foot by springing back to and/or toward their original shape when the force sufficiently abates/relaxes.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

Figure 1A:
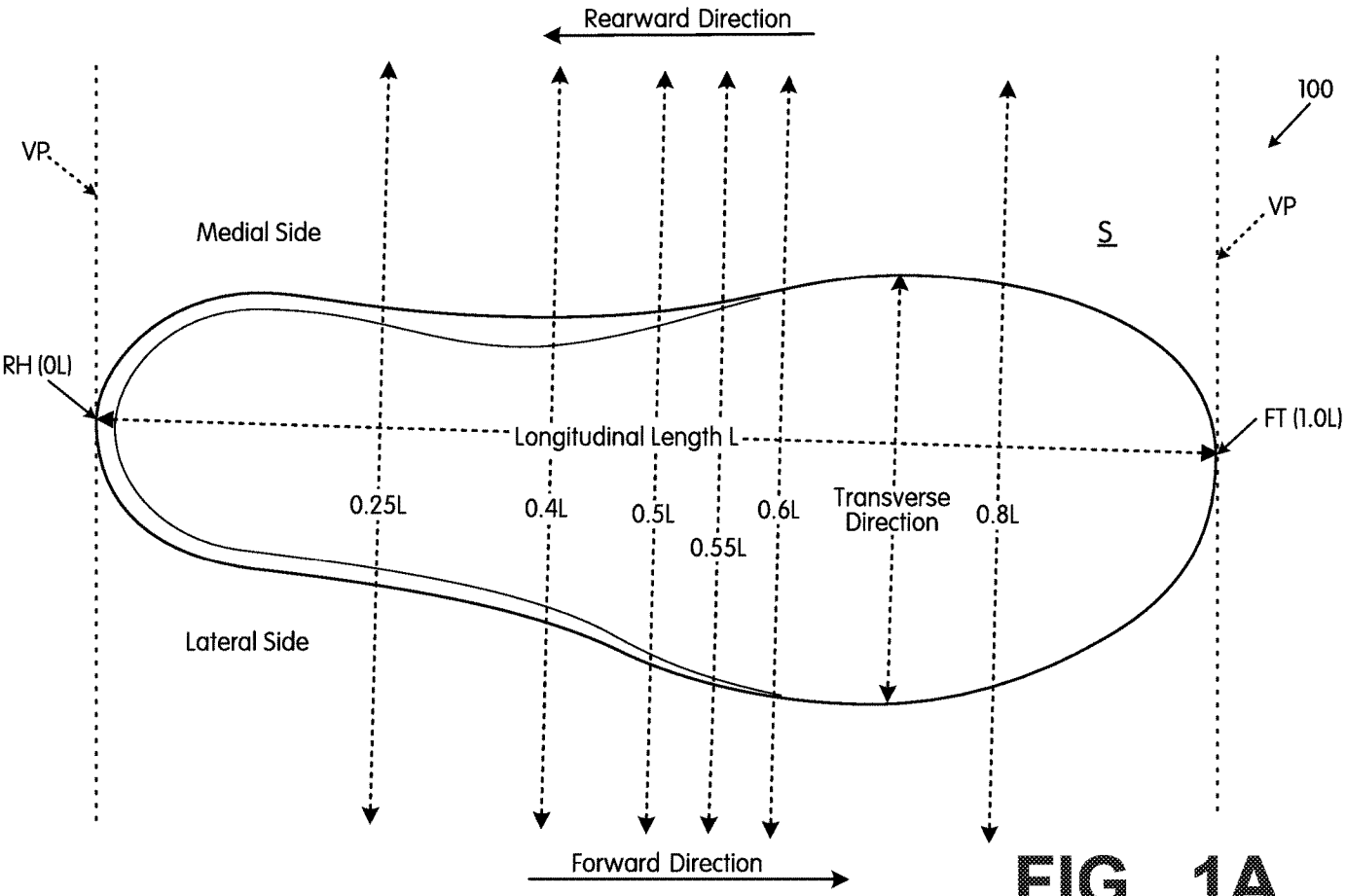
FIGS. 1A and 1B are provided to help illustrate and explain background and definitional information useful for understanding certain terminology used in this application and certain aspects of this technology.
Figure 1B:
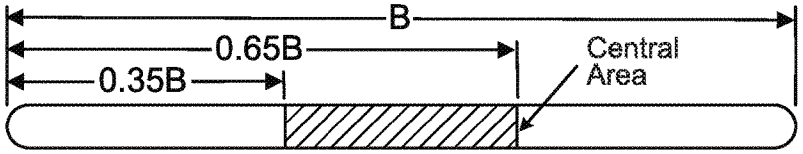

The reader should understand that the attached drawings are not necessarily drawn to scale.

DETAILED DESCRIPTION

In the following description of various examples of footwear and foot-receiving device structures and components according to the present technology, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. Detailed Description of Example Foot Support Components and/or Articles of Footwear or Other Foot-Receiving Devices According to this Invention Referring to the figures and following discussion, various foot support components, articles of footwear, and features thereof in accordance with aspects of the present invention are disclosed. Concepts disclosed with respect to these components and footwear may be applied to a wide range of athletic footwear styles, including, but not limited to: walking shoes, tennis shoes, soccer shoes, football shoes, basketball shoes, running shoes, track shoes, shoes for track field events (e.g., high jump, triple jump, etc.), cross-training shoes, etc. In addition, the concepts of the present invention may be applied to a wide range of non-athletic footwear, including work boots, sandals, loafers, and dress shoes.

Foot support components for articles of footwear according to some aspects of this technology include: (a) a lateral sidewall that extends to and forms a lateral free edge (e.g., a lateral top edge); (b) a medial sidewall located opposite the lateral sidewall, wherein the medial sidewall extends to and forms a medial free edge (e.g., a medial top edge); and (c) a base support surface that includes an exterior surface and an interior surface opposite the exterior surface. The base support surface may include a plurality of foot support members (e.g., arched foot support members, such as arched foot support slats) for supporting at least a portion of the plantar surface of a wearer's foot. When arched, at least one—and in some examples, some, a majority, or even all—of the foot support members may constitute an arched foot support slat, wherein a local extrema (e.g., a peak of the arch) of the arched foot support member (slat) is located in a central area of the arched foot support member (slat) between the lateral sidewall and the medial sidewall. The arched foot support member(s)/slat(s) may originate at or proximate to the lateral sidewall and/or at or proximate to the medial sidewall at locations spaced away from the lateral free edge and the medial free edge. In some example structures, at least some of the arched foot support members/slats are separated from one another by open spaces, e.g., spaces that extend between (e.g., continuously and completely) and separate at least 90% of a rearward edge of one arched foot support component/slat from at least 90% of a forward edge of an adjacent arched foot support component/slat. In still other example structures, the spaces may extend (e.g., continuously and completely) to separate at least 75%, at least 80%, at least 85%, at least 95%, or even at least 98% of a rearward edge of one arched foot support component/slat from at least 75%, at least 80%, at least 85%, at least 95%, or even at least 98% of a forward edge of an adjacent arched foot support component/slat.

As some more specific examples of these aspects of the technology, the base support surface may include: (a) a first arched foot support slat, wherein a local extrema (e.g., a peak of the arch) of the first arched foot support slat is located in a central area of the first arched foot support slat between the lateral sidewall and the medial sidewall, and wherein the first arched foot support slat originates at or proximate to the lateral sidewall and the medial sidewall at respective locations spaced away from the lateral free edge and the medial free edge, (b) a second arched foot support slat, wherein a local extrema (e.g., a peak of the arch) of the second arched foot support slat is located in a central area of the second arched foot support slat between the lateral sidewall and the medial sidewall, and wherein the second arched foot support slat originates at or proximate to the lateral sidewall and the medial sidewall at respective locations spaced away from the lateral free edge and the medial free edge, (c) a third arched foot support slat, wherein a local extrema (e.g., a peak of the arch) of the third arched foot support slat is located in a central area of the third arched foot support slat between the lateral sidewall and the medial sidewall, and wherein the third arched foot support slat originates at or proximate to the lateral sidewall and the medial sidewall at respective locations spaced away from the lateral free edge and the medial free edge, (d) a first open space extending between (e.g., continuously and completely) and separating at least 90% of a rearward edge of the first arched foot support slat from at least 90% of a forward edge of the second arched foot support slat, and (e) a second open space extending between (e.g., continuously and completely) and separating at least 90% of a rearward edge the second arched foot support slat from at least 90% of a forward edge of the third arched foot support slat. In some example structures, the first open space and/or the second open space may extend to continuously and completely separate at least 75%, at least 80%, at least 85%, at least 95%, or even at least 98% of a rearward edge of one arched foot support component/slat from at least 75%, at least 80%, at least 85%, at least 95%, or even at least 98% of a forward edge of an adjacent arched foot support component/slat. In these example structures, each of the first open space and the second open space constitutes a through hole extending completely through the base support surface from the exterior surface of the base support surface to the interior surface of the base support surface.

Additionally or alternatively, foot support components for articles of footwear in accordance with at least some aspects and examples of this technology may include: (a) a lateral sidewall that extends to and forms a lateral free edge (e.g., lateral top edge); (b) a medial sidewall located opposite the lateral sidewall, wherein the medial sidewall extends to and forms a medial free edge (e.g., medial top edge); and (c) a base support surface that includes an exterior surface and an interior surface opposite the exterior surface. The base support surface may include a plurality of foot support members (e.g., arched foot support members, such as arched foot support slats) for supporting at least a portion of the plantar surface of a wearer's foot. When arched, at least one—and in some examples, some, a majority, or even all—of the foot support members may include a forward edge extending between: (i) a first lateral origination point located at or proximate to the lateral sidewall and (ii) a first medial origination point located at or proximate to the medial sidewall, and a rearward edge extending between: (i) a second lateral origination point located at or proximate to the lateral sidewall and (ii) a second medial origination point located at or proximate to the medial sidewall, and wherein one or more of the arched foot support members further include a single local extrema (for that arched foot support member) located in a central area of the arched foot support member between the lateral sidewall and the medial sidewall. Additionally or alternatively, when arched, at least one—and in some examples, some, a majority, or even all—of the foot support members may include: (i) a lateral end point located at or proximate to the lateral sidewall, (ii) a medial end point located at or proximate to the medial sidewall, (iii) a forward edge defined at least in part by a forward open space located between the foot support member and a forwardly adjacent foot support member, (iv) a rearward edge defined at least in part by a rearward open space located between the foot support member and a rearwardly adjacent foot support member, and (v) a single local extrema (for that arched foot support member) located in a central area of the arched foot support member between the lateral sidewall and the medial sidewall. In any of these examples, the forward edge of one foot support member may be substantially parallel with the rearward edge of a forwardly adjacent foot support member, and/or the forward edge of the one foot support member may be separated from the rearward edge of the forwardly adjacent foot support member over at least 85% of a breadth dimension of the noted forward edge (or over at least 85% of a breadth dimension of the rearward foot support member) and/or over at least 85% of a breadth dimension of the noted rearward edge (or over at least 85% of a breadth dimension of the forward foot support member). In some examples, the forward edge of the one foot support member may be separated from the rearward edge of the forwardly adjacent foot support member over at least 75%, at least 80%, at least 90%, at least 95%, or even at least 98% of the breadth dimensions of either or both of the noted foot support members. In such examples, one or more of the support members may be continuous and separated from one another over their entire breadth(s), one or more of the support members may be discontinuous in their lateral side-to-medial side breadth dimension (e.g., have a gap therein), and/or one or more of the support members may be joined to one or both adjacent support members, e.g., by bridging material extending or crossing over the space between adjacent support members.

As some more specific examples of these aspects of the technology, the base support surface may include:

(a) a first arched foot support member that includes: (i) a first lateral end point located at or proximate to the lateral sidewall, (ii) a first medial end point located at or proximate to the medial sidewall, (iii) a first forward edge defined at least in part by a first open space, (iv) a first rearward edge defined at least in part by a second open space, and (v) a single local extrema for the first arched foot support member located in a central area of the first arched foot support member between the lateral sidewall and the medial sidewall, (b) a second arched foot support member that includes: (i) a second lateral end point located at or proximate to the lateral sidewall, (ii) a second medial end point located at or proximate to the medial sidewall, (iii) a second forward edge defined at least in part by the second open space, (iv) a second rearward edge defined at least in part by a third open space, and (v) a single local extrema for the second arched foot support member located in a central area of the second arched foot support member between the lateral sidewall and the medial sidewall, wherein the second forward edge is substantially parallel with the first rearward edge, and wherein the second forward edge is separated from the first rearward edge: (1) over at least 85% of a breadth dimension of the second arched foot support member, and/or (2) over at least 85% of a breadth dimension of the first arched foot support member, and (c) a third arched foot support member that includes: (i) a third lateral end point located at or proximate to the lateral sidewall, (ii) a third medial end point located at or proximate to the medial sidewall, (iii) a third forward edge defined at least in part by the third open space, (iv) a third rearward edge defined at least in part by a fourth open space, and (v) a single local extrema for the third arched foot support member located in a central area of the third arched foot support member between the lateral sidewall and the medial sidewall, wherein the third forward edge is substantially parallel with the second rearward edge, and wherein the third forward edge is separated from the second rearward edge: (1) over at least 85% of a breadth dimension of the third arched foot support member, and/or (2) over at least 85% of a breadth dimension of the second arched foot support members.

In these examples, the forward edge of one foot support member may be separated from the rearward edge of the forwardly adjacent foot support member over at least 75%, at least 80%, at least 90%, at least 95%, or even at least 98% of the breadth dimensions of either or both of the noted foot support members. Further, one or more additional arched foot support members, having any one or more of the features of the first, second, and third arched foot support members, may be included (e.g., arranged forward and/or rearward of the first, second, and third arched foot support members) in the base support surface and/or foot support component without departing from this technology.

Additionally or alternative, as some more specific examples, the base support surface may include:

(a) a first arched foot support member that includes a first forward edge extending between: (i) a first lateral origination point located at or proximate to the lateral sidewall and (ii) a first medial origination point located at or proximate to the medial sidewall and a first rearward edge extending between: (i) a second lateral origination point located at or proximate to the lateral sidewall and (ii) a second medial origination point located at or proximate to the medial sidewall, and wherein the first arched foot support member includes a first single local extrema located in a central area of the first arched foot support member between the lateral sidewall and the medial sidewall, (b) a second arched foot support member that includes a second forward edge extending between: (i) a third lateral origination point located at or proximate to the lateral sidewall and (ii) a third medial origination point located at or proximate to the medial sidewall and a second rearward edge extending between: (i) a fourth lateral origination point located at or proximate to the lateral sidewall and (ii) a fourth medial origination point located at or proximate to the medial sidewall, and wherein the second arched foot support member includes a second single local extrema located in a central area of the second arched foot support member between the lateral sidewall and the medial sidewall, wherein the second forward edge is substantially parallel with the first rearward edge, and wherein the second forward edge is separated from the first rearward edge over at least 85% of a breadth dimension of the second arched foot support member, and (c) a third arched foot support member that includes a third forward edge extending between: (i) a fifth lateral origination point located at or proximate to the lateral sidewall and (ii) a fifth medial origination point located at or proximate to the medial sidewall and a third rearward edge extending between: (i) a sixth lateral origination point located at or proximate to the lateral sidewall and (ii) a sixth medial origination point located at or proximate to the medial sidewall, and wherein the third arched foot support member includes a third single local extrema located in a central area of the third arched foot support member between the lateral sidewall and the medial sidewall, wherein the third forward edge is substantially parallel with the second rearward edge, and wherein the third forward edge is separated from the second rearward edge over at least 85% of a breadth dimension of the third arched foot support member.

In these examples, the forward edge of one foot support member may be separated from the rearward edge of the forwardly adjacent foot support member over at least 75%, at least 80%, at least 90%, at least 95%, or even at least 98% of the breadth dimensions of either or both of the noted foot support members. Further, one or more additional arched foot support members, having any one or more of the features of the first, second, and third arched foot support members, may be included (e.g., arranged forward and/or rearward of the first, second, and third arched foot support members) in the base support surface and/or foot support component without departing from this technology.

Additional aspects of this technology relate to more specific features of the various footwear components described above and described in more detail below as well as additional features or structures included in the footwear components. Such additional aspects may include: more specific features of a footwear component including the lateral and medial sidewalls and the base support surface, e.g., features of a connecting wall (e.g., a rear heel wall, a forward toe wall); features of connecting the above footwear component with other footwear components, such as foam midsole components, bladder midsole components, other midsole components, outsole components, footwear upper components, etc.; various dimensional features of the footwear components; etc. These additional aspects of the technology may be included as part of any of the individual examples and aspects of the technology described in the paragraphs above.

Still additional aspects of this technology relate to methods of making footwear components and/or articles of footwear containing them, e.g., of the types and having the structures described above (and described in more detail below).

Given the above background and general description of aspects and examples of this technology, a more detailed description of specific examples of articles of footwear in accordance with at least some examples of this technology and this invention follows.

II. Detailed Description of Specific Example Foot Support Components and/or Articles of Footwear According to this Invention FIGS. 2A-2J show various views of foot support components 250 and articles of footwear 200 containing foot support components 250 in accordance with at least some aspects of this technology. The term "foot support component" as used herein may include any one or more foot support parts, e.g., forming the entirety and/or a portion of a sole structure for an article of footwear 200. Such "foot support components" may include, for example, any individual part and/or combination of two or more foot support parts shown in the example of FIGS. 2A-2J. Various features, characteristics, and/or parts of example articles of footwear 200 and foot support components 250 thereof are described in more detail below.

Figure 2A:
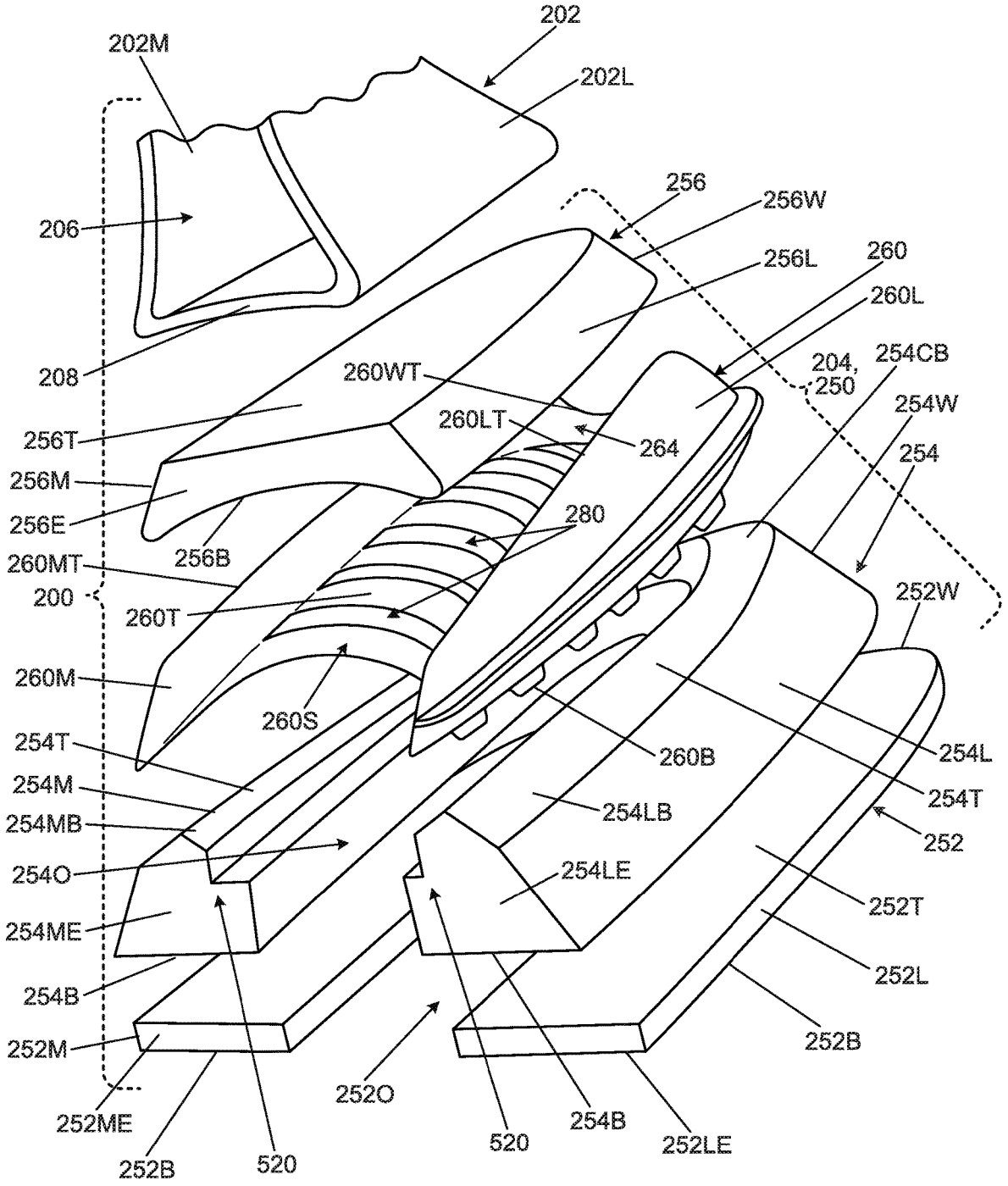
FIGS. 2A and 2B provide an exploded view and a rear heel view of a heel area and/or heel components of foot support components, sole structures, and/or articles of footwear in accordance with some examples of this technology.

The article of footwear 200 of FIG. 2A includes an upper 202 and a sole structure 204 engaged with the upper 202. As noted above, foot support components 250 in accordance with aspects of this technology may constitute all or a portion of the sole structure 204. The upper 202 and sole structure 204 may be engaged together in any desired manner, including in manners conventionally known and used in the footwear arts (such as by one or more of adhesives or cements, stitching or sewing, mechanical connectors, etc.).

The upper 202, potentially together with the sole structure 204, define a foot-receiving interior chamber 206 for containing a wearer's foot. The bottom of the upper 202 may include a strobel 208 or other component engaged with or integrally formed with another portion of the upper 202 e.g., a lateral side upper component 202L and/or a medial side upper component 202M. The upper 202 may include other components as well. For example, the upper 202 may include: a tongue member located across the foot instep area and positioned to moderate the feel of the footwear's closure system on the wearer's foot; a closure system (e.g., including one or more of a lace type closure system, a zippered closure system, a buckle type closure system, elastic stretch elements, etc.); a heel counter; a toe cap; straps; etc. Additionally or alternatively, the upper 202 may include a "sock-like" upper component, e.g., made from fabric and configured to closely fit the wearer's foot like a conventional sock.

The upper 202 may be made from any desired material(s) and/or in any desired constructions and/or manners without departing from this technology. As some more specific examples, all or at least a portion of the upper 202 (and optionally a majority, substantially all, or even all of the upper 202) may be formed as a woven textile component, a knitted textile component, another textile component, a natural leather component, a synthetic leather component, a polymeric component (e.g., a TPU, etc.), etc. The components for upper 202 may have structures and/or constructions like those used in footwear products commercially available from NIKE, Inc. of Beaverton, Oreg. and/or other manufacturers.

Additionally or alternatively, if desired, the upper 202 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this technology may include foot securing and engaging structures of the types used in footwear products commercially available from NIKE, Inc. of Beaverton, Oreg. These types of wrap-around and/or adaptive or dynamic fit structures may at least partially wrap around, conform to, and/or securely hold the wearer's foot.

As yet another alternative or additional feature, if desired, uppers 202 and articles of footwear 200 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oreg. As still additional examples, uppers of the types described in U.S. Pat. No. 7,347,011 and/or 8,429,835 may be used without departing from this technology (each of U.S. Pat. Nos. 7,347,011 and 8,429,835 is entirely incorporated herein by reference).

Figure 2B:
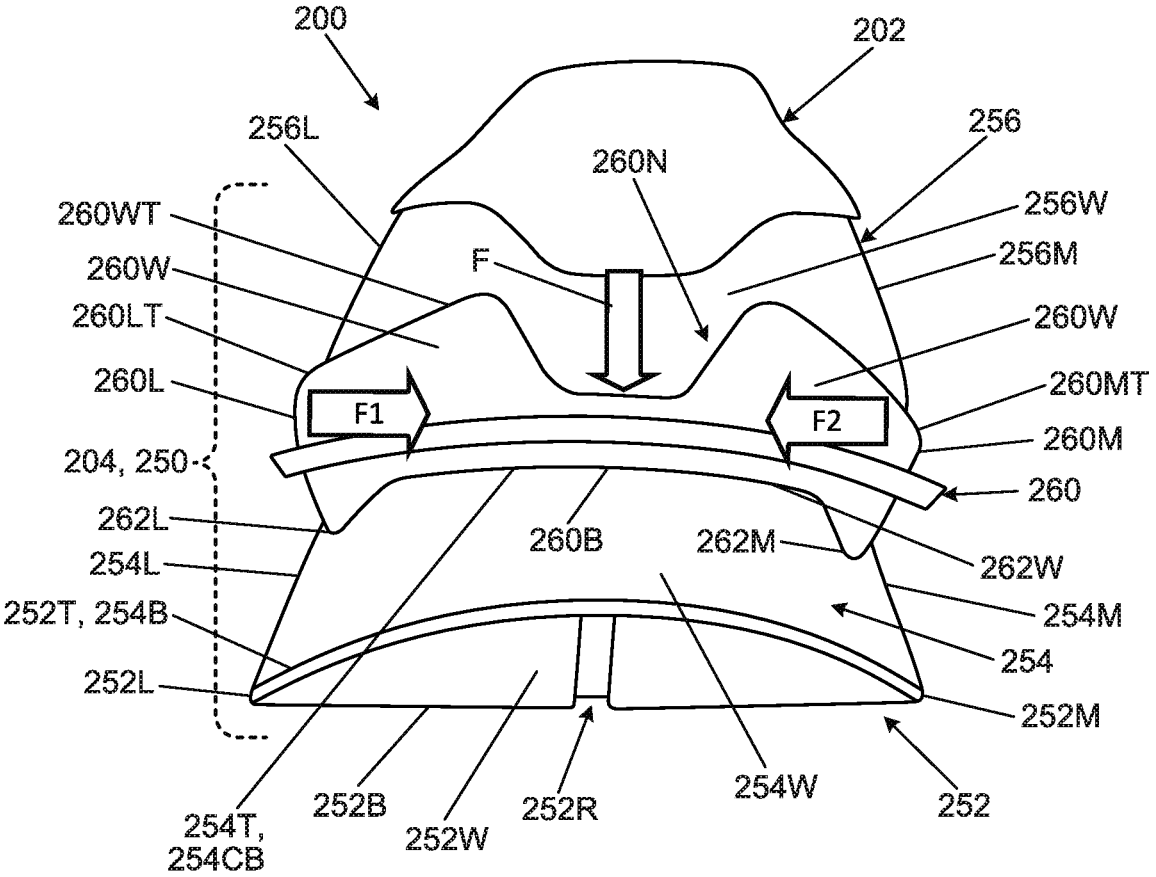

The example foot support components 250 shown in FIGS. 2A and 2B now will be described in more detail. FIG. 2A shows an exploded perspective view of an example foot support component 250 and FIG. 2B provides an assembled rear view of a foot support component 250. As illustrated in these figures, this example footwear sole structure 204 and/or foot support component 250 includes: (a) an outsole component 252; (b) a lower midsole component 254 (also called a "first midsole component" or a "first midsole system" herein); (c) an upper midsole component 256 (also called a "second midsole component" or a "second midsole system" herein); and (d) an intermediate midsole component 260 (also called a "foot support component" or a "midsole component" herein) at least partially located between the lower midsole component 254 and the upper midsole component 256. Various example structures, features, and/or characteristics of these various footwear sole structures 204 and/or foot support components 250/parts are described in more detail below.

Outsole component 252 of this example sole structure 204/foot support component 250 may have any desired structure, function, and/or characteristics and may be made from any desired material(s) without departing from this technology, including conventional structures, functions, characteristics and/or materials as are known and used in the footwear arts. As some more specific examples, outsole component 252 may be formed from rubber, polymeric materials, or the like. The bottom surface 252B thereof may include traction elements, treads, cleats, spikes, and/or any other desired configurations, including any conventional configuration for sport specific uses. The outsole component 252 may include wear resistant/abrasion resistant materials and may be designed to contact the ground or other contact surface in use. While other shapes are possible, in these illustrated examples, the outsole component 252 includes an intermediate recess or central open space 252O between a lateral side arm 252L and a medial side arm 252M, as well as a rear connecting wall 252W connecting the lateral side arm 252L and the medial side arm 252M. Thus, in this manner, the outsole component 252 may have a generally U-shape, including a generally U-shaped outer perimeter and a generally U-shaped inner perimeter (and the outsole component 252 may terminate, e.g., in a midfoot area or heel area of the sole structure 204, at lateral free end 252LE and medial free end 252LM). While FIG. 2A shows the top surface 252T of outsole component 252 having a generally planar surface, FIG. 2B shows an alternative in which the top surface 252T is contoured (e.g., upwardly arched in the lateral side-to-medial side direction).

The U-shape of outsole component 252 is not a requirement in all aspects of this technology, although some type of central open space may be advantageous in accordance with at least some examples of this technology. For example, the central open space (e.g., 252O) of outsole component 252 may enhance flexibility between the lateral side and medial side of the sole structure 204, e.g., promoting/enhancing natural motion. Also, the central open space (e.g., 252O) can provide room for vertical displacement of other components of the foot support component 250, e.g., in response to a foot force (e.g., landing a step or jump), as will be described in more detail below. The central open space (e.g., 252O) of outsole component 252 also could be provided, if desired, by a generally round, oval, or elliptically shaped outsole component, by a rounded rectangular shaped outsole component, by another open ended or close ended outsole configuration, and/or by providing separate medial and lateral side components (e.g., omitting connecting wall 252W), etc. The open space 252O may have any desired shape as well. In at least some examples of this invention, the open space 252O of outsole component 252 may define a horizontal cross sectional area between side arms 252L and 252M of at least 10 $cm^2$, and in some examples at least 15 $cm^2$, at least 20 $cm^2$, at least 25 $cm^2$, at least 30 $cm^2$, at least 40 $cm^2$, at least 50 $cm^2$, or even at least 60 $cm^2$ (this area may be measured as the horizontal cross-sectional area of the opening 252O with the outsole component 252 supported on its ground-facing surface on a horizontal base surface in an unloaded condition (e.g., without weight applied to the outsole component 252, other than perhaps the weight of other components making up the foot support component 250, sole structure 204, and/or article of footwear)).

The outsole component 252 in this example foot support component 250 structure is engaged with a lower midsole component 254. In this illustrated example, lower midsole component 254 includes a bottom surface 254B engaged with the top surface 252T of the outsole component 252. Any desired manner of engagement between lower midsole component 254 and outsole component 252 may be employed without departing from this technology, including fixed or releasable connections. As some more specific examples, these components 252/254 may be engaged together via one or more of: cements or adhesives; mechanical fasteners or hardware; fused or welded connections; etc.

The lower midsole component 254 of this example attenuates impact forces (e.g., when a wearer's foot contacts a surface when landing a step or jump) and may have any desired constructions and/or number of parts without departing from this technology (including conventional constructions and/or parts as are known and used in the footwear arts). In some more specific examples, the lower midsole component 254 may include one or more of: (a) a foam material and/or one or more foam components; (b) one or more fluid-filled bladders; (c) one or more mechanical shock absorbing components; etc.

While other shapes are possible, in the illustrated examples of FIGS. 2A and 2B, the lower midsole component 254 includes an intermediate recess or central open space 254O between a lateral side arm 254L and a medial side arm 254M, as well as a rear connecting wall 254W connecting the lateral side arm 254L and the medial side arm 254M. Thus, in this manner, the lower midsole component 254 may have a generally U-shape, including a generally U-shaped outer perimeter and a generally U-shaped inner perimeter (and the lower midsole component 254 may terminate, e.g., in a midfoot area or heel area of the sole structure 204, at lateral free end 254LE and medial free end 254LM).

The U-shape of lower midsole component 254 is not a requirement in all aspects of this technology, although some type of central open space may be advantageous in accordance with at least some examples of this technology. For example, the central open space (e.g., 254O) of lower midsole component 254 may enhance flexibility between the lateral side and medial side of the sole structure 204, (e.g., promoting/enhancing natural motion). Also, the central open space (e.g., 254O) can provide room for vertical displacement of other components of the foot support component 250, e.g., in response to a foot force (e.g., landing a step or jump), as will be described in more detail below. The central open space (e.g., 254O) of lower midsole component 254 also could be provided, if desired, by a generally oval, round, or elliptically shaped lower midsole component, by a rounded rectangular shaped lower midsole component, by another open ended or close ended lower midsole configuration, and/or by providing separate medial and lateral side components (e.g., omitting connecting wall 254W), etc. The open space 254O may have any desired shape as well. In at least some examples of this invention, the open space 254O of midsole component 254 may define a horizontal cross sectional area between side arms 254L and 254M of at least 10 $cm^2$, and in some examples at least 15 $cm^2$, at least 20 $cm^2$, at least 25 $cm^2$, at least 30 $cm^2$, at least 40 $cm^2$, at least 50 $cm^2$, or even at least 60 $cm^2$ (this area may be measured as the horizontal cross-sectional area of the opening 254O with the foot support component 250, sole structure 204, and/or article of footwear 204 supported on its ground-facing surface on a horizontal base surface in an unloaded condition (e.g., without weight applied to the midsole component 254, other than perhaps the weight of other components making up the foot support component 250, sole structure 204, and/or article of footwear)).

Foot support component 250 of this example includes an upper midsole component 256, e.g., located closest to the wearer's foot in this illustrated example. In some examples, this upper midsole component 256 may be located directly beneath, and in some examples directly engaged with, the upper 202 (e.g., with the bottom surface, such as a strobel 208, of the upper 202). Thus, the upper midsole component 256 of this example includes a top surface 256T engaged with the bottom surface of the upper 202 (e.g., strobel 208). Any desired manner of engagement between upper midsole component 256 and upper 202 may be employed without departing from this technology, including fixed or releasable connections. As some more specific examples, these components 202/256 may be engaged together via one or more of: cements or adhesives; mechanical fasteners or hardware; fused or welded connections; etc. Also, the upper midsole component 256 of this example includes a bottom surface 256B engaged with the top surface 260T of the midsole component 260 (which is described in more detail below). Any desired manner of engagement between upper midsole component 256 and midsole component 260 may be employed without departing from this technology, including fixed or releasable connections. As some more specific examples, these components 256/260 may be engaged together via one or more of: cements or adhesives; mechanical fasteners or hardware; fused or welded connections; etc.

The upper midsole component 256 attenuates impact forces (e.g., when a wearer's foot contacts a surface when landing a step or jump) and/or provides a comfortable base surface for engaging at least a portion of the wearer's foot. This upper midsole component 256 may have any desired constructions and/or number of parts without departing from this technology (including conventional constructions and/or parts as are known and used in the footwear arts). In some more specific examples, the upper midsole component 256 may include one or more of: (a) a foam material and/or one or more foam components; (b) one or more fluid-filled bladders; (c) one or more mechanical shock absorbing components; etc. In at least some examples of foot support components 250 in accordance with aspects of this technology, when both an upper midsole component 256 and a lower midsole component 254 are present, the lower midsole component 254 may be "firmer" than the upper midsole component 256. This may be determined, for example, by determining which component responds with greater deflection under an applied force or load (e.g., with the "firmer" component vertically displacing or deflecting less than the vertical displacement or deflection of the "softer" component under the same applied force conditions). When both components 254/256 are made from and/or include a foam material, the "firmer" component may be considered as the foam material having a greater hardness property (e.g., greatest durometer or hardness on a Shore A scale) and/or greater density and the "softer" component may be considered as the foam material having a lower hardness property (e.g., lower durometer or hardness on a Shore A scale) and/or lower density. In some more specific examples, the upper midsole component 256 may be made from a foam material that is at least 10 Shore A hardness points lower than the foam material of the lower midsole component 254 (and in some examples, at least 15 points, at least 20 points, at least 25 points, at least 30 points, or even at least 35 points lower on the Shore A scale).

While other shapes are possible, in the illustrated examples of FIGS. 2A and 2B, the upper midsole component 256 has a lateral side wall 256L and a medial side wall 256M, as well as a rear wall 256W connecting the lateral side wall 256L and the medial side wall 256M. The upper midsole component 256 may have a half-oval or a half-elliptical shape, e.g., including a generally U-shaped outer perimeter. This example upper midsole component 256 terminates, e.g., in a midfoot area or heel area of the sole structure 204, at free end 256E.

The midsole component 260 (which itself may be considered a "foot support component" or a portion thereof in accordance with this invention) now will be described in more detail in conjunction with FIGS. 2A-2J. This midsole component 260 may constitute a one piece or multi-piece construction, e.g., made from rigid plastic material(s), such as a thermoplastic polyurethane ("TPU") material; a polyether block amide thermoplastic elastic polymer material (e.g., available under the PEBAX® brand (from Arkema) and/or VESTAMID® E brand (from Evonik)); a fiber-reinforced composite plastic component (e.g., carbon fiber reinforced composite, glass fiber reinforced composite, etc.); etc. In some examples, the midsole component 260 will be formed as a rigid, yet flexible and resilient construction, e.g., capable of deforming or deflecting under an applied force (e.g., from a wearer landing a step or jump or otherwise applying foot force), but resiliently returning to its original shape when the applied force is sufficiently relaxed or reduced. In some examples, the midsole component 260 may be considered to include a "plate" like base structure (e.g., a relatively thin base surface, and in some examples formed from a plurality of "slat" type members extending across the midsole component 260 (and, if present, across an open space defined by open area(s) 254O and/or 252O)). The material making up the midsole component may be a rigid plastic material having a Shore D hardness within a range of 20 to 80 Shore D, and in some examples, between 25 and 80, between 30 and 80, between 35 and 80, between 40 and 75, or even between 50 and 75 Shore D.

As shown in FIGS. 2A-2J, the midsole component 260 of this example foot support component 250 includes: (a) a lateral sidewall 260L that extends to and forms a lateral free edge (260LT—lateral top edge); (b) a medial sidewall 260M located opposite the lateral sidewall 260L that extends to and forms a medial free edge (260MT—medial top edge); and (c) a base support surface 260S that includes an exterior surface (260B—bottom surface) and an interior surface (260T—top surface) opposite the exterior surface 260B. The base support surface 260S of this illustrated example includes a plurality of arched foot support members 270, which in some examples may take on the form of arched foot support slats (e.g., upwardly arched when in an unloaded condition and oriented on a horizontal support surface with its ground-facing surface oriented downward). The individual arched foot support members/slats 270 in a single foot support component 250 may have the same size and/or shape features as other individual arched foot support members/slats 270 or one or more arched foot support members/slats 270 may have a different size and/or shape in one or more dimensions than at least one other arched foot support members/slats 270 in that same foot support component 250 and/or midsole component 260.

Any number of arched foot support members/slats 270 may be included in a foot support component 250 without departing from this technology. As some more specific examples, a foot support component 250 and/or midsole component 260 may have any one or more of: (a) at least 2 individual arched foot support members/slats 270; (b) at least 3 individual arched foot support members/slats 270; (c) at least 5 individual arched foot support members/slats 270; (d) from 2 to 45 individual arched foot support members/slats 270; (e) from 2 to 35 individual arched foot support members/slats 270; (f) from 2 to 25 individual arched foot support members/slats 270; (g) from 2 to 20 individual arched foot support members/slats 270; (h) from 2 to 16 individual arched foot support members/slats 270; (i) from 3 to 12 individual arched foot support members/slats 270; and or (j) from 3 to 8 individual arched foot support members/slats 270. Rather than arched foot support members/slats 270, one or more (up to all) of the foot support members/slats 270 may be planar, substantially planar, or unarched (e.g., planar, substantially planar, or unarched when in an unloaded condition and oriented on a horizontal support surface with its ground-facing surface oriented downward).

Figure 2C:
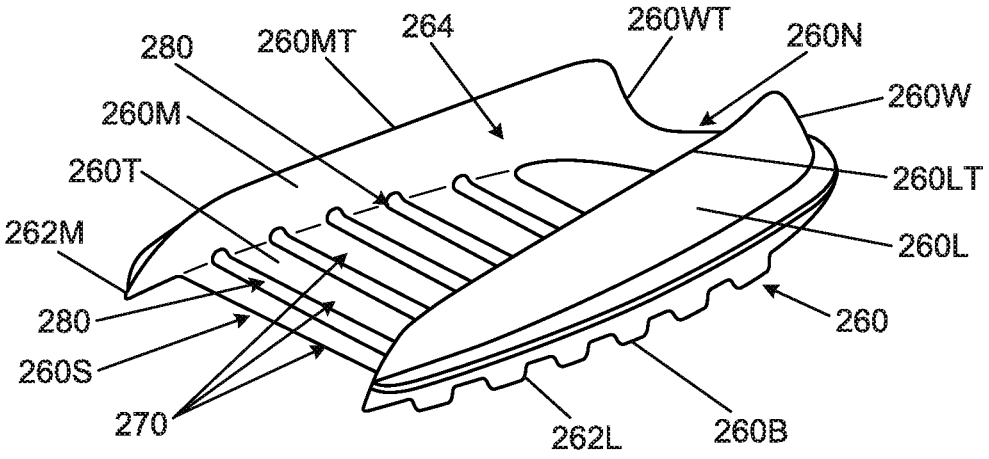
FIG. 2C provides a perspective view of an example foot support component (or portion thereof) in accordance with some examples of this technology.
Figure 2D:
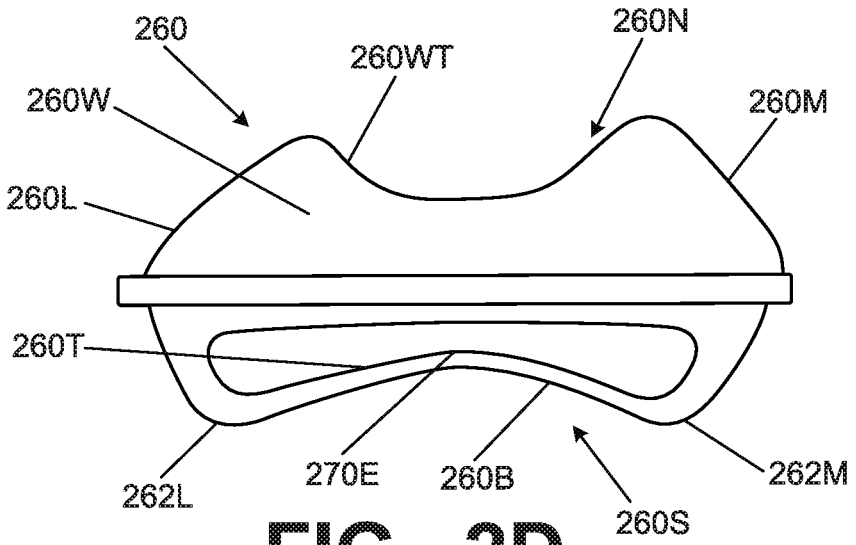
FIG. 2D provides a rear view of an example foot support component (or portion thereof) in accordance with some examples of this technology.
Figure 2E:
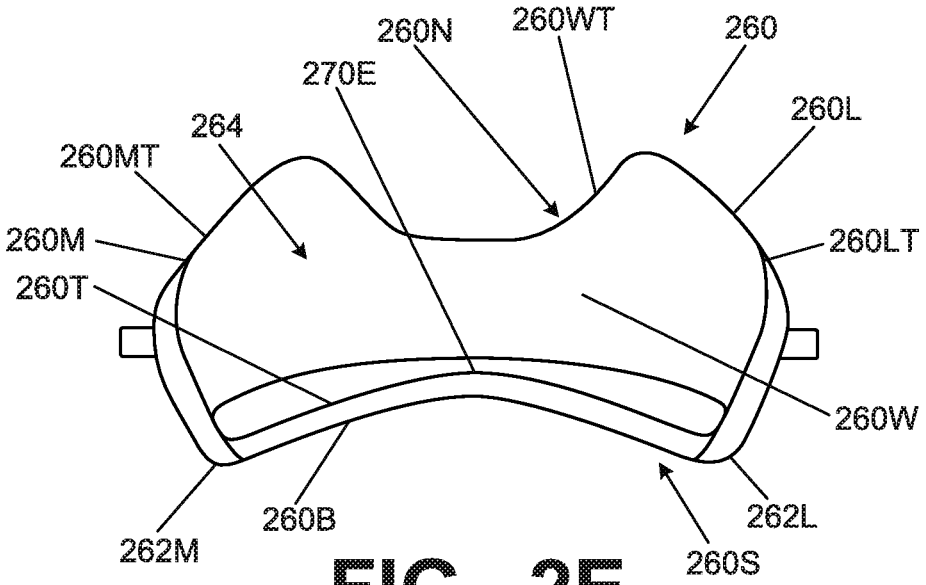
FIG. 2E provides a front view of an example foot support component (or portion thereof) in accordance with some examples of this technology.

In foot support components 250 (including in the illustrated midsole component 260 of this example) according to at least some examples of this technology, at least one individual arched foot support member/slat 270 will include a local extrema 270E, e.g., a single inflection point or peak of the arch/curve of the individual arched foot support member/slat 270 (see FIGS. 2D and 2E). While just one individual foot support member/slat 270 may include this arched/curved structure, in some examples of this technology: (a) a plurality of the individual foot support members/slats 270 of the foot support component 250/midsole component 260 will include the arched/curved shape and local extrema 270E features, (b) a majority of the individual foot support members/slats 270 of the foot support component 250/midsole component 260 will include the arched/curved shape and local extrema 270E features, or even (c) all of the individual foot support members/slats 270 of the foot support component 250/midsole component 260 will include the arched/curved shape and local extrema 270E features. Additionally or alternatively, a plurality, a majority, or all of the foot support members/slats 270 in a midsole component 260 may have a planar (flat) surface or a substantially planar surface.

The individual foot support members/slats 270 of a foot support component 250/midsole component 260 may extend in any desired direction without departing from this technology. As some more specific examples, one, a plurality, a majority, or even all of the individual foot support members/slats 270 of a foot support component 250/midsole component 260 may extend in the transverse direction of the sole structure 204/article of footwear 200 as described above in conjunction with FIG. 1A. As other examples, one, a plurality, a majority, or even all of the individual foot support members/slats 270 of a foot support component 250/midsole component 260 may extend in a generally lateral side-to-medial side direction of the sole structure 204/article of footwear 200, e.g., extending from proximate to the lateral sidewall 260L to proximate to the medial sidewall 260M of the midsole component 260 (and in some examples, originating at or proximate to the lateral sidewall 260L and/or the medial side-wall 260M). Additionally or alternatively, as shown in FIGS. 2A and 2C, one, a plurality, a majority, or even all of the individual foot support members/slats 270 of a foot support component 250/midsole component 260 may originate at locations spaced away from the lateral free edge 260LT and/or at locations spaced away from the medial free edge 260MT.

FIGS. 2D and 2E further illustrate that the local extrema 270E of at least one individual arched foot support member/slat 270 (and, in some examples, at least a plurality, at least a majority, or even all of the individual arched foot support members/slats 270) is located in a central area of that arched foot support member/slat 270 (i.e., within the central 35% to 65% of the arched foot support member/slat 270 in its longest dimension B (in its breadth dimension in this illustrated example)). As some additional examples, if desired, the local extrema 270E of at least one individual arched foot support member/slat 270 (and, in some examples, at least a plurality, at least a majority, or even all of the individual arched foot support members/slats 270) may be located within the central 40% to 60% of the arched foot support member/slat 270 in its longest dimension B (e.g., in its breadth dimension) or even within the central 45% to 55% of the arched foot support member/slat 270 in its longest dimension B (e.g., in its breadth dimension).

As further shown in this illustrated example (e.g., FIGS. 2A, 2C, 2H-2J), the individual arched foot support members/slats 270 are separated from one another by open spaces 280, e.g., openings extending completely through the midsole component 260 of this example (e.g., from its top surface 260T to its bottom surface 260B). As shown in FIGS. 2H-2J, at least one open space 280 (and in some examples, a plurality of the open spaces 280, a majority of the open spaces 280, or even all of the open spaces 280) may extend continuously to at least partially separate one arched foot support member/slat 270 from an adjacent arched foot support member/slat 270. The open space(s) 280 may be positioned and shaped to completely separate at least 90% of a rearward edge 270RE of one arched foot support member/slat 270 from at least 90% of a forward edge 270FE of a rearwardly adjacent arched foot support member/slat 270. See FIG. 2J. In some examples, the open space(s) 280 may be positioned and shaped to completely separate at least 80%, at least 85%, at least 95%, at least 98%, or even 100% of a rearward edge 270RE of one arched foot support member/slat 270 from at least 80%, at least 85%, at least 95%, at least 98%, or even 100% of a forward edge 270FE of a rearwardly adjacent arched foot support member/slat 270. These spaces 280 shape and/or member/slat 270 separation features may be provided between any number of adjacent foot support member/slat 270 pairs in the overall midsole component 260 structure.

FIG. 2J illustrates various dimensional features of open spaces 280 (e.g., breadth dimension B1, width dimension W1) and foot support members/slats 270 (e.g., breadth dimension B2, width dimension W2) in midsole components 260 in accordance with at least some examples of this invention. The breadth dimensions B1, B2 may be the longest dimensions of the open space 280 and foot support member/slat 270, respectively, e.g., a lateral side-to-medial side dimension. The width dimensions W1, W2 may be transverse to their corresponding breadth dimension B1, B2, respectively, e.g., a heel-to-toe dimension.

For generally rectangular shaped spaces 280 and/or foot support members/slats 270, determining the dimensions B1, B2, W1, and/or W2 may be readily evident from the structures themselves (e.g., the shortest and/or most direct distance from one edge to the opposite edge). If the directions for determining these various dimensions are not readily evident from the structures of the open space 280 and/or foot support members/slats 270, one or more of the dimensions may be determined as follows. First, the outermost points or end points 280LE and 280ME at the lateral side and medial side of the relevant open space 280 are located. Then, the breadth dimension B1 of the open space 280 may be determined as the distance between these outermost end points 280LE, 280ME across the open space 280 as shown in FIG. 2J. In many instances, the breadth dimension B1 will correspond to the largest dimension of the space 280. Outermost points or end points 280LE and 280ME at the lateral side and medial side of an open space 280 also can be considered the "origination points" of the forward and rear edges (280FE, 280RE) of the open space 280. The width dimension W1 will correspond to the distance from an open space 280's forward edge 280FE to its rear edge 280RE across the open space and perpendicular to the breadth dimension B1. If the width of the open space 280 varies over the breadth dimension B1, then the width dimension W1 may be considered as the widest width dimension present across the open space 280 that is perpendicular to the breadth dimension B1.

Outermost points or end points 280LE and 280ME at the lateral side and medial side of an open space 280 also may be considered the "origination points" 270LE, 270ME, respectively, of forward edges 270FE and rear edges 270RE of the foot support members/slats 270 (and of the foot support members/slats 270 themselves). A foot support member/slat 270's breadth dimension B2 may be determined: (a) by drawing a lateral end line 282L between adjacent lateral end points 280LE of two adjacent open spaces 280, (b) by drawing a medial end line 282M between adjacent medial end points 280ME of two adjacent open spaces 280, (c) finding the midpoints 270LMP and 270MMP of the lateral end line 282L and the medial end line 282M, respectively, and (d) determining the dimension B2 between the lateral midpoint 270LMP and the medial midpoint 270MMP as the foot support member/slat 270's breadth dimension B2. The foot support member/slat 270's width dimension W2 will correspond to the distance from a foot support member/slat 270's forward edge 270FE to its rear edge 270RE across the foot support member/slat 270 and perpendicular to the breadth dimension B2. If the width of the foot support member/slat 270 varies over the breadth dimension B2, then the width dimension W2 may be considered as the widest width dimension present across the foot support member/slat 270 that is perpendicular to the breadth dimension B2.

Dimensions B1, W1, B2, and W2 can take on any suitable values, e.g., any values that will provide the desired impact force attenuation properties for midsole component 260 (in combination with any other present foot support components, such as midsole components 254, 256). As some more specific examples, open space 280's breadth dimension B1 and/or foot support member/slat 270's breadth dimension B2 may have one or more of the following properties: (a) at least 15 mm long, (b) at least 20 mm long, (c) at least 30 mm long, (d) at least 40 mm long, (e) at least 50 mm long, (f) less than 150 mm long, (g) less than 120 mm long, (h) less than 100 mm long, (i) less than 90 mm long, (j) from 15 mm to 150 mm long, (k) from 18 mm to 120 mm long, (l) from 20 mm to 100 mm long, (m) from 25 mm to 90 mm long, and/or (n) from 30 mm to 85 mm long. Additionally or alternatively, as some more specific examples, open space 280's width dimension W1 and/or foot support member/slat 270's width dimension W2 may have one or more of the following properties: (a) at least 1 mm wide, (b) at least 2 mm wide, (c) at least 4 mm wide, (d) at least 8 mm wide, (e) at least 10 mm wide, (f) less than 25 mm wide, (g) less than 20 mm wide, (h) less than 18 mm wide, (i) less than 16 mm wide, (j) from 1 mm to 25 mm wide, (k) from 2 mm to 20 mm wide, (l) from 3 mm to 18 mm wide, (m) from 4 mm wide to 16 mm wide, and/or (n) from 5 mm wide to 12 mm wide. The ratios of B1/W1 and/or B2/W2 may be within one or more of the ranges of: (a) 0.5 to 150, (b) 0.75 to 120, (c) 1 to 100, (d) 1 to 80, (e) 1 to 60, (f) 1.25 to 50, (g) 1.5 to 40, (h) 1.5 to 40, (i) 1.75 to 25, (i) 2 to 20, (j) 2.2 to 18, and/or (k) 2.3 to 15. The ratio of W1 to W2 may be within one or more of the ranges of: (a) 0.05 to 5, (b) 0.1 to 3, (c) 0.15 to 2, (d) 0.2 to 1.8, (e) 0.25 to 1.5; and/or (f) 0.5 to 1.25. The ratio of B1 to B2 may be within one or more of the ranges of: (a) 0.5 to 1.5, (b) 0.6 to 1.4, (c) 0.75 to 1.25, (d) 0.8 to 1.15, and/or (e) 0.9 to 1.1.

Figure 2F:
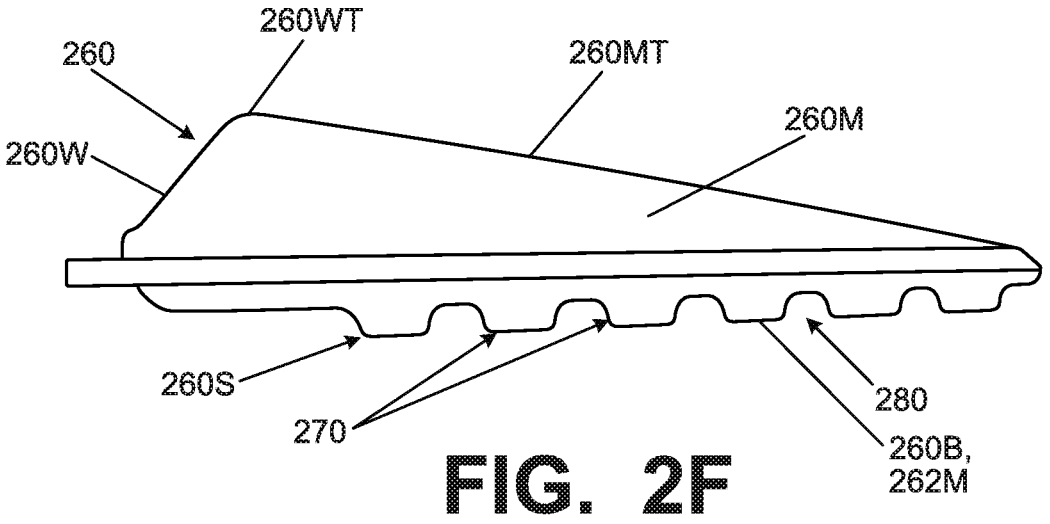
FIGS. 2F and 2G provide medial side and lateral side views, respectively, of an example foot support component (or portion thereof) in accordance with some examples of this technology.
Figure 2G:
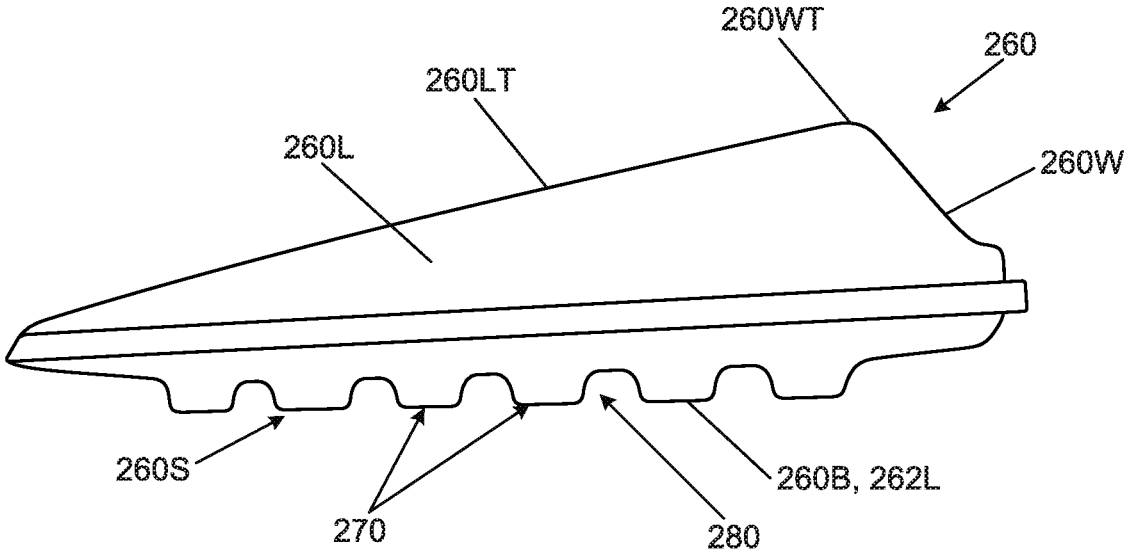
Figure 2I:
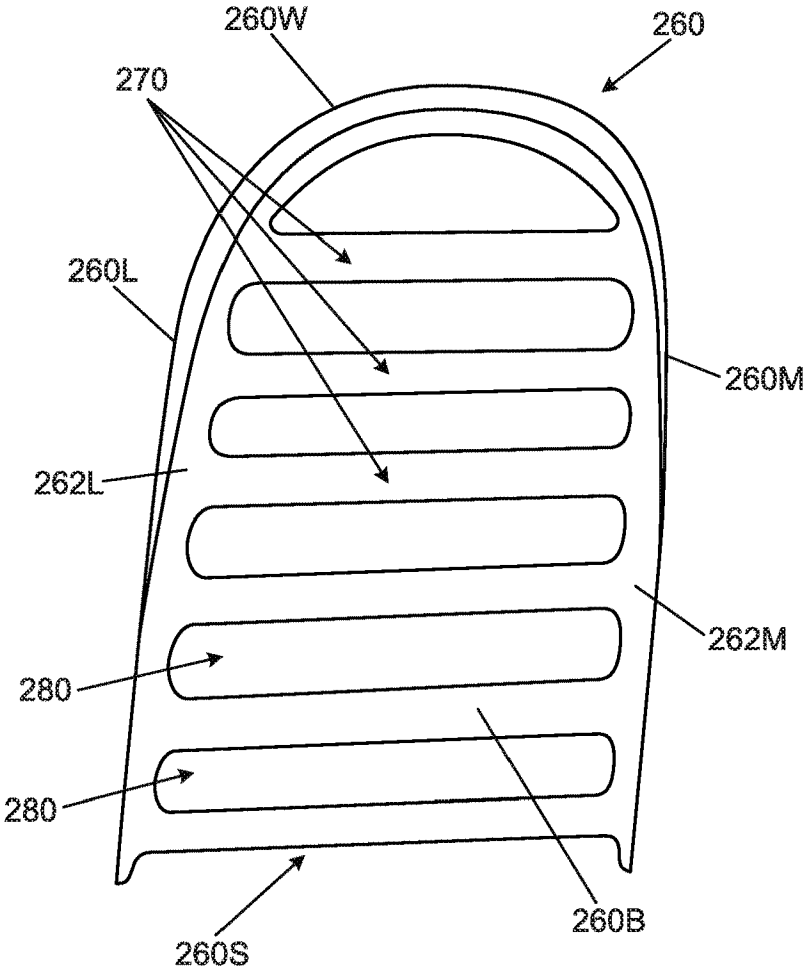
FIGS. 2H and 2I provide top and bottom views, respectively, of an example foot support component (or portion thereof) in accordance with some examples of this technology.
Figure 2H:
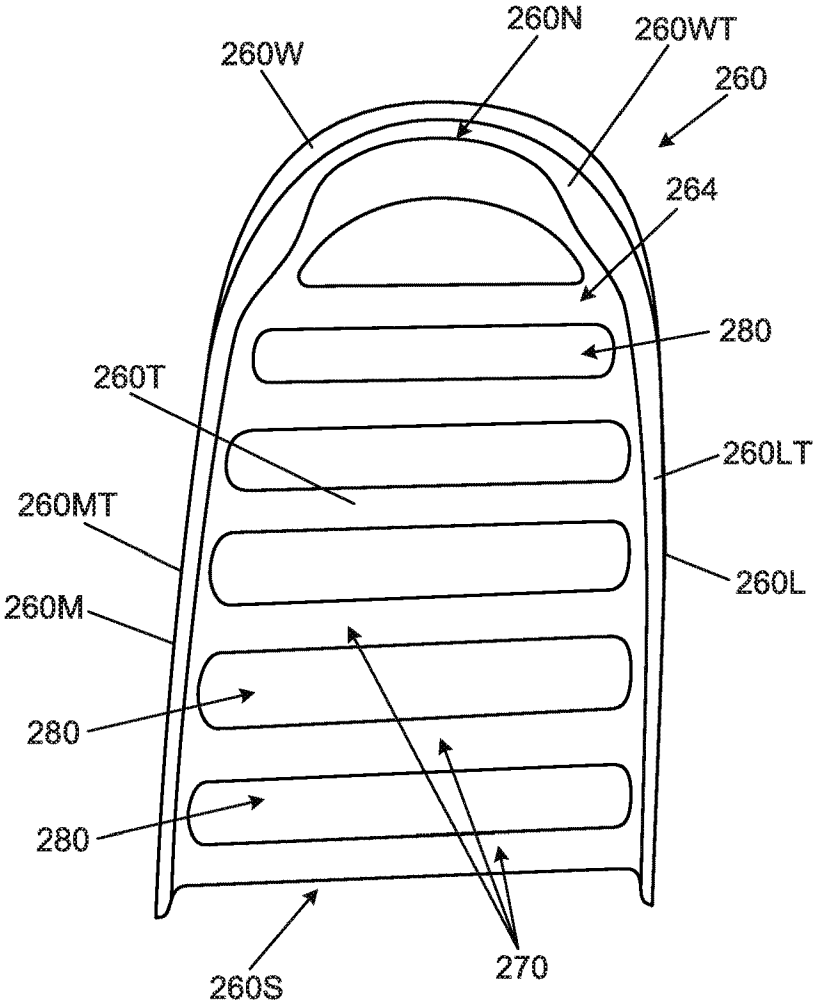
Figure 2J:
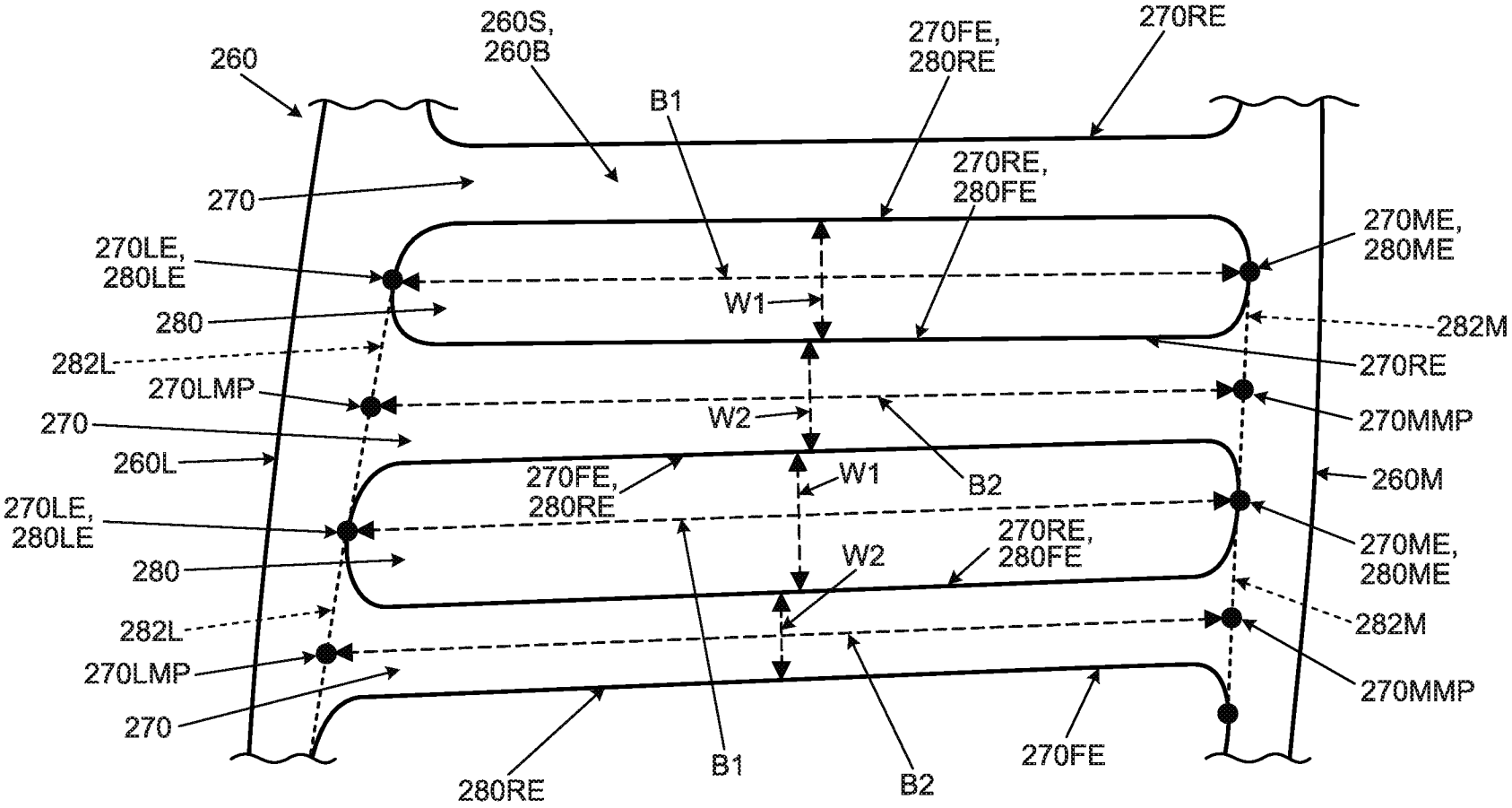
FIG. 2J provides an enlarged view of a portion of a foot support component in accordance with some examples of this technology.

The overall midsole component 260 and/or its sidewalls 260L, 260M, and 260W may have any desired height dimension HW or vertical height (e.g., from the top edge 260LT, 260MT, 260WT to its bottommost location when resting on a horizontal base surface—see FIGS. 2F, 2G) without departing from this invention. Further, as shown in these figures, the height dimension HW or vertical height may vary at different locations along the top edges 260LT, 260MT, 260WT (e.g., top edges 260LT and 260MT may be sloped, curved or otherwise changed in height; top edge 260WT may include the notch feature 260N or other slope/curvature feature; etc.). As some more absolute dimensions, the wall height dimension HW or vertical height may be up to 50 mm or even more, particularly in examples in which the midsole component's sidewall(s) 260L, 260M, and/or 260W may provide functions of a footwear heel counter. As some additional absolute dimensional ranges, in some examples, the tallest wall height dimension HW and/or maximum vertical height of midsole component 260 may have one or more of the following characteristics at any one or more of sidewall(s) 260L, 260M, and/or 260W: (a) at least 3 mm, (b) at least 5 mm, (c) at least 10 mm, (d) at least 15 mm, (e) at least 20 mm, (f) less than 50 mm, (g) less than 35 mm, (h) less than 30 mm, (i) less 25 mm, (j) between 3 mm and 50 mm, (k) between 5 mm and 35 mm, and/or (l) between 10 mm and 30 mm.

Additionally or alternatively, at least one, a plurality, a majority, or even all of the open space(s) 280 may be sized, shaped, and positioned so that: (a) in its longest dimension (e.g., B1, FIG. 2J), its forward edge 280FE will be substantially parallel to its rearward edge 280RE, and/or (b) it separates adjacent foot support members/slats 270 from one another. In this manner, the forward edge 270FE of one or more of the individual foot support members/slats 270 will be substantially parallel to the rearward edge 270RE of a forwardly adjacent foot support member/slat 270 over at least some portion of each of these foot support member/slat 270 longest dimensions (B2 in FIG. 2J) and/or edge lengths. In some examples of this technology, the open spaces 280 and foot support members/slats 270 may be structured and arranged such that the forward edge 270FE of one or more of the individual foot support members/slats 270 will be substantially parallel to the rearward edge 270RE of a forwardly adjacent foot support member/slat 270 over at least 75%, at least 80%, at least 85%, at least 90%, at least 95%, or even 100% of one or both of the adjacent foot support members/slats 270 longest dimensions and/or edge lengths. The "forward edge" 270FE and the "rearward edge" 270RE of an individual foot support member/slat 270 may be found by: (a) extending a lateral end line 282L from the outermost lateral location of the forward open space 280 to the outermost lateral location of the rearward open space 280 that define the individual foot support member/slat 270 and (b) extending a medial end line 282M from the outermost medial location of the forward open space 280 to the outermost medial location of the rearward open space 280 that define the individual foot support member/slat 270. The relevant edges 270FE, 270RE, 280FE, 280RE begin/end where the end lines 282L, 282M reach the open spaces 280 defining the foot support member/slat 270. The longest or breadth dimension of the open space 280 (B1) is the dimension from 280LE to 280ME. The longest or breadth dimension of the foot support member/slat 270 (B2) may be measured from the lateral midpoint (270LMP) of lateral end line 282L to the medial midpoint (270MMP) of the medial end line 282M. See FIG. 2J. The lateral midpoint 270LMP and the medial midpoint 270MMP may be considered "end points" of the foot support members/slats 270 (e.g., if no other "end point" is readily apparent from the structure itself), e.g., for dimensional determinations or calculations.

Thus, the foot support component 250 (including the midsole components 260 of the illustrated examples of FIGS. 2A-2J) includes: (a) a lateral sidewall 260L that extends to and forms a lateral free edge 260LT; (b) a medial sidewall 260M located opposite the lateral sidewall 260L that extends to and forms a medial free edge 260MT; and (c) a base support surface 260S that includes an exterior surface 260B and an interior surface 260T opposite the exterior surface 260B. In these illustrated examples, the base support surface 260S includes one or more arched foot support members/slats 270, e.g., as described above. At least one of the arched foot support members/slats 270 (and in some examples, a plurality, a majority, or even all of the arched foot support members/slats 270) may include: (i) a lateral origination point 270LE and/or a lateral end or midpoint 270LMP located at or proximate to the lateral sidewall 260L, (ii) a medial origination point 270ME and/or a medial end or midpoint 270MMP located at or proximate to the medial sidewall 260M, (iii) a forward edge 270FE extending from a forward lateral origination point 270LE to a corresponding forward medial origination point 270ME, (iv) a rearward edge 270RE extending from an adjacent rearward lateral origination point 270LE to a corresponding adjacent rearward medial origination point 270ME, and (v) a single local extrema 270E for that arched foot support member/slat 270 located in a central area of the first arched foot support member/slat 270 between the lateral sidewall 260L and the medial sidewall 270M (e.g., measured from breadth dimension B2 between midpoints 270LMP and 270MMP).

While FIGS. 2A-2J illustrate foot support members/slats 270 and spaces 280 having substantially constant dimensions and parallel orientations within an individual midsole component 260, the sizes, shapes, dimensions, orientations, and/or other features of the foot support members/slats 270 and/or spaces 280 may be varied within an individual midsole component 260. These features also may be varied, e.g., for customization/optimization purposes, as will be described in more detail below.

FIGS. 2A-2I show other features that may be incorporated into foot support components 250, e.g., in the illustrated midsole component 260, in accordance with at least some examples of this technology. As one example, a connecting wall 260W (which may constitute a rear heel wall and/or a front toe wall in some sole structures 204/foot support components 250/midsole components 260 in accordance with this technology) connects the lateral sidewall 260L and the medial sidewall 260M. This connecting wall 260W may extend to and form a connecting wall free edge 260WT (e.g., a top edge when oriented in a sole structure 204 with the sole structure 204 supported on its ground facing surface on a horizontal plane). This connecting wall free edge 260WT may (in at least some examples) extend between and continuously connect the lateral free edge 260LT and the medial free edge 260MT (e.g., extend from the lateral free edge 260LT to the medial free edge 260T). Further, as shown in this illustrated example, the connecting wall free edge 260WT may define and be formed to include a notched or concave top edge portion 260N and a notched wall 260W. The notched or concave portion 260N may be used, at least in part, to define a bend line or location (e.g., a pre-defined longitudinal bend line or bend location) to promote and facilitate bending of the lateral side and the medial side of the foot support component 250/midsole component 260 with respect to one another (e.g., to move the free ends 260LT and 260MT toward one another and to more tightly engage the wearer's foot, as shown by arrows F1 and F2 in FIG. 2B).

Other ways of supporting and/or promoting a pre-defined bend location may be used without departing from this technology. Some examples include: including one or more hinge structures (e.g., in the connecting wall 260W and/or within the breadth dimension of one or more foot support members/slats 270); including a compressible material as part of the connecting wall 260W and/or within the breadth dimension of one or more foot support members/slats 270; providing one or more gaps in the connecting wall 260W and/or within the breadth dimension of one or more foot support members/slats 270; providing one or more perforated areas and/or predefined bend lines in the connecting wall 260W and/or within the breadth dimension of one or more foot support members/slats 270; etc. Such structures may promote bending in one direction while resisting bending in the opposite direction (at least resisting bending in the opposite direction once the sole structure 204/foot support component 250/midsole component 260 returns to its unbent or preloaded condition (e.g., after the force from landing the step or jump is removed or sufficiently reduced)).

Alternatively or additionally, in at least some examples of this technology, the connecting wall 260W (when present) may constitute a forward toe wall and be located in the forefoot area (e.g., the extreme forward toe area) of a sole structure 204/foot support component 250/midsole component 260. Some sole structures 204/foot support components 250/midsole components 260 in accordance with this technology may include connecting walls 260W at both the rear heel area and the forward toe area of the structure. In such examples with two connecting walls 260W, either or both or neither of the connecting walls 260W may include a notched area 260N and/or other pre-defined bend features of the types described above.

FIGS. 2A-2I illustrate additional or alternative potential features of sole structures 204/foot support components 250/midsole components 260 in accordance with aspects of this technology. For example, as shown, the exterior surface 260B of the base support surface 260S may include: (a) a lateral base edge 262L (e.g., a lower lateral base edge) located on an opposite side of the lateral sidewall 260L from the lateral free edge 260LT, (b) a medial base edge 262M (e.g., a lower medial base edge) located on an opposite side of the medial sidewall 260M from the medial free edge 260MT, and, optionally, if a connecting wall 260W is present, (c) a connecting base edge 262W (e.g., a lower edge) located on an opposite side of the connecting wall 260W from the connecting wall free edge 260WT. Additionally or alternatively, the lower midsole component 254 may include (e.g., as part of its top surface 254T): (a) a lateral base edge 254LB (e.g., an upper edge), (b) a medial base edge 254MB, and, optionally, if a connecting wall 260W is present, (c) a connecting base edge 254CB. Such sole structures 204 and/or foot support components 250 may have one or more of the following: (a) the lateral base edge 254LB of the lower midsole component 254 may be engaged with the lateral base edge 262L of the base support surface 260S, (b) the medial base edge 254MB of the lower midsole component 254 may be engaged with the medial base edge 262M of the base support surface 260S, and/or (c) the connecting base edge 254CB of the lower midsole component 254 may be engaged with the connecting base edge 262W of the base support surface 260S. These engagements may be provided in any desired manner, (e.g. through the use of one or more of: adhesives, mechanical fasteners, and/or fusing techniques).

In the example sole structure 204/foot support component 250 shown in FIG. 2A, the lower midsole component 254 has a U-shaped structure in which the lateral base edge 254LB and the lateral sidewall 254L of the lower midsole component 254 form a lateral arm of the U-shaped structure, the medial base edge 254MB and the medial sidewall 254M of the lower midsole component 254 form a medial arm of the U-shaped structure, and the connecting base edge 254CB and the connecting wall 254W of the lower midsole component form a base of the U-shaped structure (connecting the above-noted medial and lateral side edges and sidewalls). The U-shaped structure of the lower midsole component 254 defines an open space 254O between the lateral arm (and lateral sidewall 254L) and the medial arm (and medial sidewall 254M).

FIGS. 2A-2I further show that these example foot support components 250 (including the midsole component 260) may form a receptacle 264 for receiving at least a portion of an impact force attenuating component, such as at least a portion of the upper midsole component 256 in this illustrated example. As a more specific example: (a) an interior surface of the lateral sidewall 260L, (b) an interior surface of the medial sidewall 260M, (c) an interior surface of the connecting wall 260W (when present), and (d) the interior surface 260T of the base support surface 260S may define receptacle 264. At least a portion of the upper midsole component 256 (e.g., its bottom surface 256B and at least some of its sidewalls 256L, 256M) may be received in this receptacle 264. In some examples, two or more of the corresponding surfaces of the midsole component 260 and the upper midsole component 256 may be engaged together, e.g., by an adhesive, by a fastener, by fusing techniques, etc.

As also noted above, the article of footwear 200/sole structure 204/foot support component 250 of this example may include an outsole system 252. The outsole system 252 may comprise one or more outsole components including a surface structured and arranged to contact the ground (or other contact surface) in use (e.g., when worn by a wearer). The illustrated example outsole system 252 of FIG. 2A includes: (a) a lateral outsole element or lateral side arm 252L having its top surface 252T engaged with the bottom surface 254B of the lateral side arm 254L of the lower midsole component 254; (b) a medial outsole element or medial side arm 252L having its top surface 252T engaged with the bottom surface 254B of the medial side arm 254M of the lower midsole component 254.

In operation, at least some examples of this technology will attenuate impact forces, e.g., by compressing the midsole components 254, 256 and/or vertically displacing the foot support members/slats 270 of the midsole component 260. Additionally, in some examples, the foot support component 250/midsole component 260 may apply a securing force to the wearer's foot. As an example, as shown in FIG. 2B, a downward force F (e.g., from landing a step or jump) will cause one or more of the foot support members 270 (e.g., upwardly arched foot support members/slats 270) to deflect and/or flatten out under the applied force F. Because the foot support members/slats 270 are connected with the lateral sidewall 260L and the medial sidewall 260M (e.g., integrally formed with these sidewalls 260L, 260M in these examples, such as by a molding process), the downward deflection and/or flattening of the foot support members/slats 270 will cause the lateral sidewall 260L and the medial sidewall 260M to pinch inwardly (see force arrows F1 and F2 in FIG. 2B). The notched area 260N of the connecting wall 260W (or the absence of a connecting wall 260W) may further support or promote this inward bend/pinching action. This inward pinching force, when present, can help provide a more secure, stable feel to the wearer in use. As the downward force F is removed or sufficiently reduced or relaxed, the pinching force(s) F1, F2 also will be removed, reduced, or relaxed.

Figure 3A:
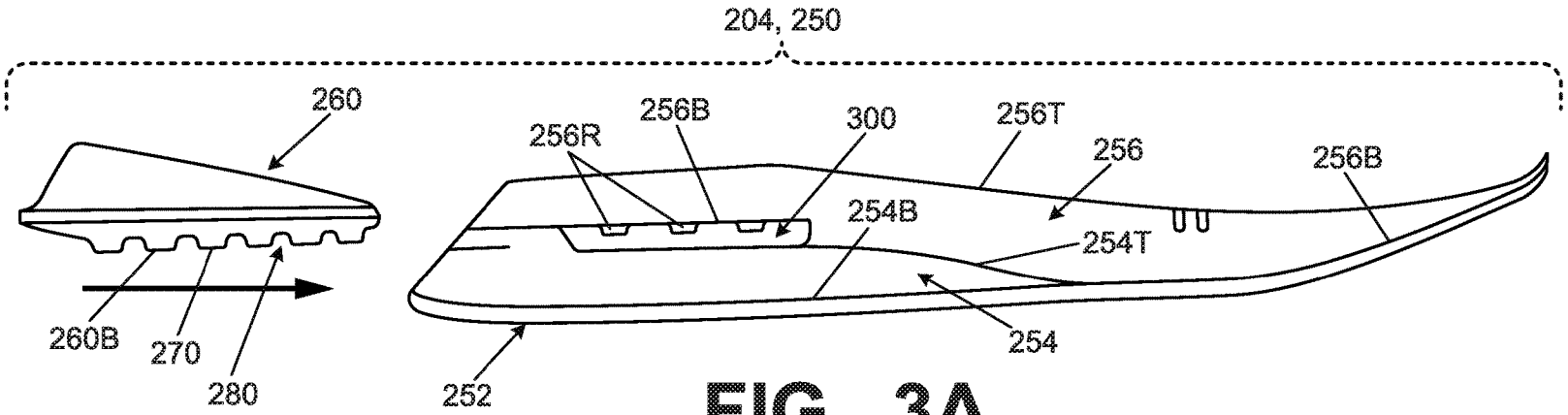
FIGS. 3A-3D illustrate examples of a footwear sole structure and assembly thereof in accordance with some examples of this technology.
Figure 3B:
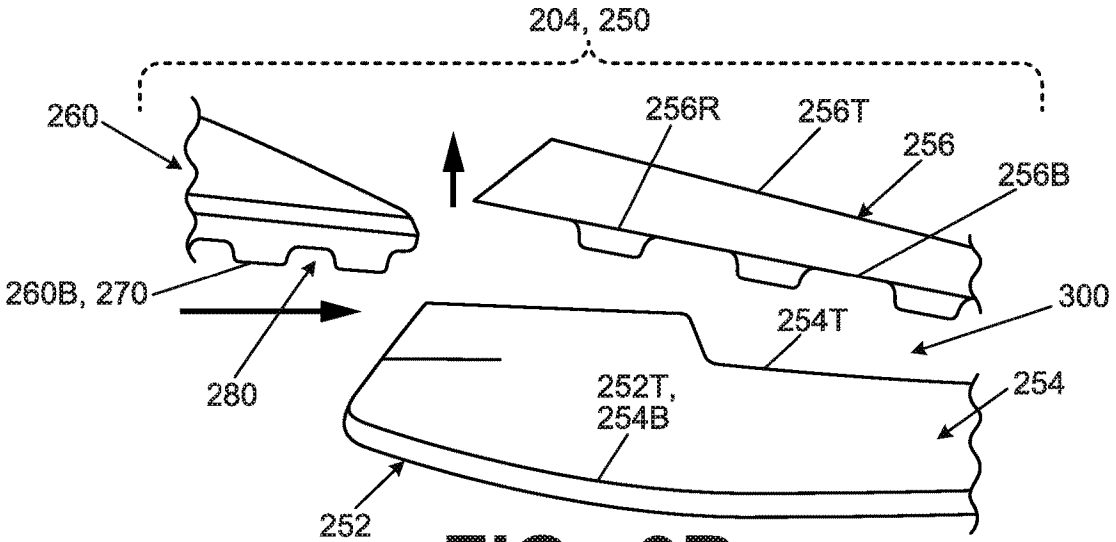
Figure 3C:
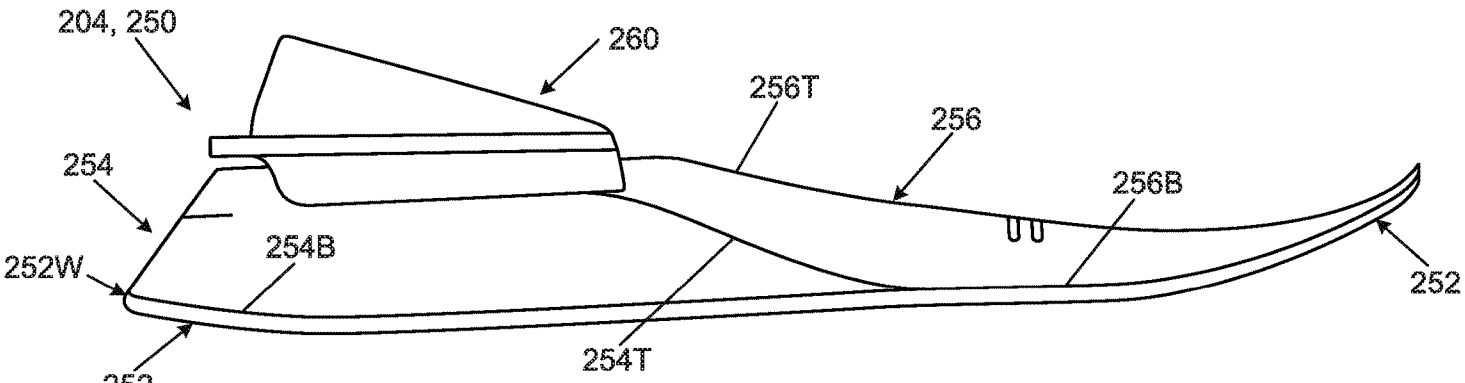

FIGS. 3A-3C illustrate an example assembly process of sole structures 204/foot support components 250 in accordance with at least some examples of this technology. As shown, the process may start with up to four components of the sole structures 204/foot support components 250, e.g., a first midsole component or system (e.g., lower midsole component 254 in this example), a second midsole component or system (e.g., upper midsole component 256 in this example), a foot support component or system (e.g., midsole component 260 in this example), and an outsole component or system (e.g., outsole component 252 in this example). In this illustrated example, the first midsole component or system 254 may extend from the rear heel area to the midfoot area of the sole structure 204/foot support component 250 (e.g., to provide ample heel/midfoot support for landing a step). On the other hand, the second midsole component or system 256 extends from the rear heel area, through the midfoot area, and to the forward toe/forefoot area of this example sole structure/foot support component 250 (e.g., including an upper surface 256T to support all (or substantially all) of the plantar surface of a wearer's foot). The outsole component 252 may be engaged with the bottom surface 254B of the first midsole component 254 where the first midsole component 254 is present (e.g., from the rear heel area to the midfoot area) and with the bottom surface 256B of the second midsole component 256 where the second midsole component 256 is present as the bottommost surface, e.g., forward of the free ends 254LE, 254ME of the midsole component 254. This engagement may be by one or more of adhesives, mechanical connectors, etc.

If desired, at an initial stage, the outsole component 252 may hold the first midsole component 254 with the second midsole component 256 without the first midsole component 254 being directly fixed to the second midsole component 256. At this stage, the first midsole component 254 may be readily movable with respect to the second midsole component 256, e.g., as shown in FIG. 3B. A recess 300 may be defined between the bottom surface 256B of the second midsole component 256 and the top surface 254T of the first midsole component 254 at this stage.

Then, with the first midsole component 254 and the second midsole component 256 held apart to expose the recess 300, the midsole component 260 may be inserted into the overall sole structure 204/foot support component 250, as shown in the progression of FIG. 3A to FIG. 3B to FIG. 3C. The bottom surface 260B (e.g., lower edges 262L, 262M) of the midsole component 260 may be engaged with the top surface 254T (e.g., upper edges of 254LB, 254MB) of the first midsole component 254 (e.g., by adhesives, mechanical connectors, etc.) and the top surface 260T of the midsole component 260 may be engaged with the bottom surface 256B of the second midsole component 256 (e.g., by adhesives, mechanical connectors, etc.). If applicable, the bottom surface 256B of upper midsole component 256 may be engaged with the top surface 254T of the lower midsole component 254, e.g., at locations where the surfaces 256B/254T contact one another e.g., forward of the free end of midsole component 260 (the midfoot areas of this illustrated example). FIG. 3C shows an example of the final assembled sole structure 204/foot support component 250 made by this process.

Alternatively, if desired, the various sole components 252, 254, 256, and/or 260 may be engaged together (and/or with other sole components, upper components, and/or footwear components) in different orders and/or in different manners. As an additional example: (a) the midsole component 260 first may be engaged with one of first midsole component 254 or second midsole component 256, (b) then that combination may be engaged with the other midsole component (254 or 256), and (c) then that combination may be engaged with the outsole component 252. These engagements may be fixed or releasable, and may include any one or more of adhesives, mechanical connectors, and/or fuse bonded/welded joints.

If desired, as shown in FIGS. 3A and 3B, the bottom surface 256B of the second midsole component 256 (the upper midsole component) may include one or more ribs 256R or other structures that fit within the space(s) 280 provided between adjacent foot support members/slats 270 of the midsole component 260. The rib(s) 256R may help engage the second midsole component 256 with the midsole component 260, help prevent undesired relative movement between these two components 256, 260, and/or help prevent undesired deflection of the foot support members/slats 270 in the heel-to-toe direction of the sole structure 204/foot support component 250. Any other type of mating and/or interlocking structure(s) on the second midsole component 256 and/or the midsole component 260 may be provided without departing from this technology (e.g., located within the space(s) 280 and/or around the foot support members/slats 270), if such mating and/or interlocking structures are desired.

This example sole structure 204/foot support component 250 assembly process (as well as other assembly processes that incorporate a foot support component like foot support member 260 into the sole structure 204/foot support component 250) provide opportunities for customization or otherwise tailoring footwear and foot support to a specific wearer and/or to a specific use (e.g., specific sports, specific activities, specific team positions, etc.). As some specific examples, plantar forces produced by a footwear wearer may be measured (e.g., using foot force measuring systems as are known and used in the art), e.g., with the wearer involved in some type of activity in which a step or jump is landed and/or other forces are applied by the wearer's foot to a contact surface and forces are applied by the contact surface to the wearer's foot. Some examples of such activities may include: walking; running; jumping; throwing a ball (or other object); swinging a bat, club, or other object; etc. Based on the measured foot forces and/or foot force changes over time and/or over plantar surface area, areas of the foot requiring different levels of support/impact force attenuation properties for that specific user may be identified. Further, based on the measured foot forces and/or foot force changes over time: (a) particular foot support member/slat 270 features and/or characteristics and/or (b) particular open space 280 features and/or characteristics may be designed to provide foot support customized and optimized for that particular wearer and/or customized and optimized for a specific sport/activity. Features and/or characteristics of the foot support member(s)/slat(s) 270 and/or features and/or characteristics of the open space(s) 280 that may be varied and/or controlled for this type of customization/optimization include any one or more of, but are not limited to: foot support member/slat 270 material; foot support member/slat 270 thickness (in the footwear upper-to-ground direction); foot support member/slat 270 breadth dimension(s) B2 and/or open space 280 breadth dimension(s) B1 (e.g., in the lateral side-to-medial side direction); foot support member/slat 270 width dimension(s) W2 and/or open space 280 width dimension(s) W1 (e.g., in the heel-to-toe direction); foot support member/slat 270 and/or open space 280 orientation (e.g., the angle and/or direction in which the longest dimension B1, B2 extends with respect to the longitudinal direction or the transverse direction of the sole structure 204 and/or foot support component 250); individual foot support member/slat 270 and/or open space 280 origination locations with respect to the sidewall(s) 260L, 260M and/or free edge(s) 260LT, 260MT of the midsole component 260; foot support member/slat 270 spacing(s); the location(s) of one or more of the foot support member(s)/slat(s) 270 and/or spaces in the longitudinal direction of the sole structure 204); the radius or other curvature feature(s) of the arch of arched foot support member(s)/slat(s) 270; the height of the local extrema 270E with respect to the bottom surface 260B of the midsole component 260 at the lateral sidewall 260L and/or the medial sidewall 260M; the location of the local extrema 270E with respect to the longest dimension of the arched foot support member(s)/slat(s) 270 (e.g., the location in the breadth dimension B2, the transverse direction, and/or another lateral side-to-medial side direction); variation in dimensions of an individual foot support member/slat 270 and/or space 280 in one or more dimensions (e.g., variation of an individual foot support member/slat 270 thickness dimension; variation of an individual foot support member/slat 270 and/or space 280 width dimension; variation of an individual foot support member/slat 270 and/or space 280 breadth dimension; and/or variation of curvature of an individual foot support member/slat 270); the number of foot support members/slats 270 and/or spaces 280; etc.

Figure 3D:
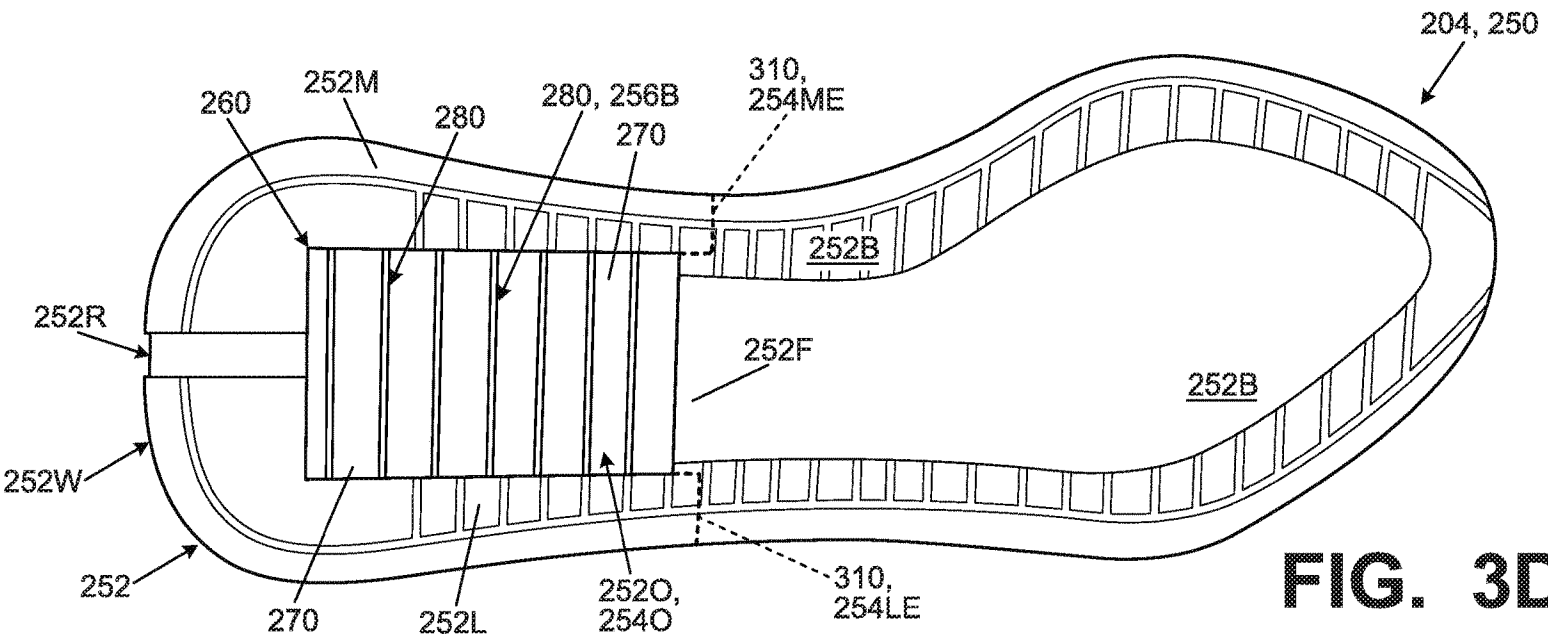

FIG. 3D provides a bottom view of an assembled sole structure 204/foot support component 250 in accordance with some examples of this technology. As described above, in at least some examples of this technology, the first midsole system 254 (e.g., the lower midsole component 254) may be substantially U-shaped, having free ends 254LE, 254ME of the U-shape located in the heel or midfoot region of the sole structure 204/foot support component 250 and a central open space 254O. The forward extent of the first midsole system 254 in this illustrated example is shown by broken line 310 in FIG. 3D. In this specific example (as described above in conjunction with FIGS. 3A-3C), the outsole component 252 (which may be made from one or more component parts) extends beyond the forward free ends 254LE, 254ME of the first midsole system 254 (i.e., beyond line 310) and directly contacts and covers the bottom surface 256B of the second midsole system 256 (e.g., the upper midsole component 256) at the midfoot and forefoot areas of the sole structure 204/foot support component 250.

As further described above, the outsole component 252 may include an intermediate recess or central open space 252O, e.g., between a lateral side arm 252L and a medial side arm 252M. Thus, the outsole component 252 may include a closed front end to close off the intermediate recess or central open space 252O, as shown by outsole portion 252F in FIG. 3D. With the exception of the central open space 252O, the remainder of the bottom of the sole structure 204/foot support component 250 of this example (around and forward of the open spaces 252O, 254O and the line 310) constitutes the bottom surface 252B of the outsole 252. In the illustrated example of FIG. 3D, the rear connecting wall 252W of the outsole component 252 includes a recess or gap 252R. This recess or gap 252R may help promote flexion of the sole structure 204/foot support component 250 along a heel-to-toe oriented axis (e.g., to provide a predetermined bend line and/or otherwise allow the lateral side of the sole structure 204/foot support component 250 to flex with respect to the medial side, e.g., during a step cycle or other use).

In sole structures 204/foot support components 250 in which an outsole opening 252O and a lower midsole component opening 254O at least partially align, e.g., as shown in FIG. 3D, at least a portion of one or more of the foot support members/slats 270 may be exposed at the exterior of the final assembled sole structure 204 and the final assembled foot support component 250. The exposed portion(s) of the one or more foot support members/slats 270 in this example includes the portion(s) of the foot support members/slats 270 located between the lateral base edge 254LB of the first midsole system 254 and the medial base edge 254MB of the first midsole system 254 (and/or between the lateral arm 252L and the medial arm 252M of the outsole component 252). Thus, the exposed portion(s) of the one or more foot support members/slats 270 may include the central area of the foot support member(s)/slat(s) 270 that contain the local extrema 270E of any arched foot support member(s)/slat(s) 270. In some examples of sole structures 204/foot support components 250 like that shown in FIG. 3D, the bottom surface 256B of the second (upper) midsole component 256 may be exposed in one or more of the spaces 280 between adjacent foot support members/slats 270.

In the example structures of FIGS. 2A-3D, each of the foot support members/slats 270 extends continuously from its lateral origination point 270LE to its medial origination point 270ME (and/or from its lateral end or midpoint 270LMP to its medial end or midpoint 270MMP), and each of the spaces 280 extends continuously from its lateral end 280LE to its medial end 280ME. These features are not requirements in all examples of this technology. FIG. 4A provides an alternative example of a foot support component in the form of a midsole component 360 similar to those described above for midsole component 260. The midsole component 360 of FIG. 4A may have any of the various features, characteristics, materials, parts, and/or properties of the midsole component 260 described above. Thus, when the same reference number is used in FIG. 4A as used in the other figures, the same or similar parts are intended, and much of the repetitive disclosure is omitted.

In the example of FIG. 4A, however, midsole component 360 includes bridge components 362 extending across one or more of the open spaces 280 to connect at least some of the adjacent foot support members/slats 270 together. The bridge components 362 may be located any place along the longest (e.g., breadth) dimensions of the foot support members/slats 270, and the bridge components 362 may extend between the adjacent foot support members/slats 270 in any direction. In some examples, a bridge component 362 may be located in the central area of the foot support members/slats 270 and/or positioned to connect local extrema 270E of two adjacent arched foot support members/slats 270. Additionally or alternatively, one or more bridge components 362 may be located outside the central area of the foot support members/slats 270 and/or positioned away from one or both of the local extrema 270E of two adjacent arched foot support members/slats 270. Also, as shown in FIG. 4A, two adjacent foot support members/slats 270 may be connected by more than one bridge components 362. The bridge component(s) 362 may be integrally formed as part of the midsole component 360 (e.g., when the midsole component 360 is molded) and may be made of the same material as the midsole component 360 (or a different material). Alternatively, one or more bridge components 362 may be separate parts engaged with two or more adjacent foot support members/slats 270 (e.g., by adhesives or cements, mechanical connectors, fusing techniques, etc.).

While FIG. 4A shows bridge components 362 connecting three pair of adjacent foot support members/slats 270, any number of bridge components 362 may be included in an individual midsole component 360 connecting any number of pair of adjacent foot support members/slats 270. One or more bridge components 362 of these types may be included in the midsole component 360 structure to allow further tuning, customization, and/or optimization of the impact force attenuation response of the midsole component 360, the foot support component 250 containing it, and/or the sole structure 204 containing it. As an example, one or more bridge components 362 may be provided at local areas of the midsole component 360 to provide increased stiffness or resistance to deflection at that local area (e.g., at area(s) identified from the foot force measurement(s) as requiring increased support).

Figure 4B:
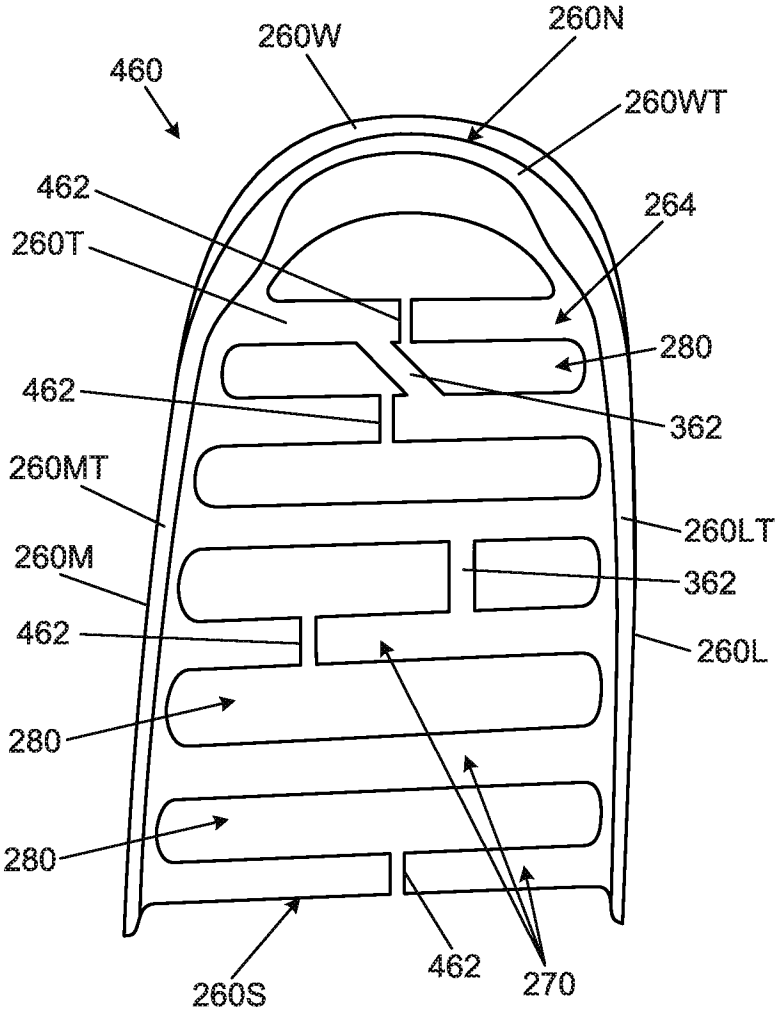
FIG. 4B illustrates an example foot support component (or portion thereof) including foot support members having a discontinuity in their central areas and/or other areas.
Figure 4A:
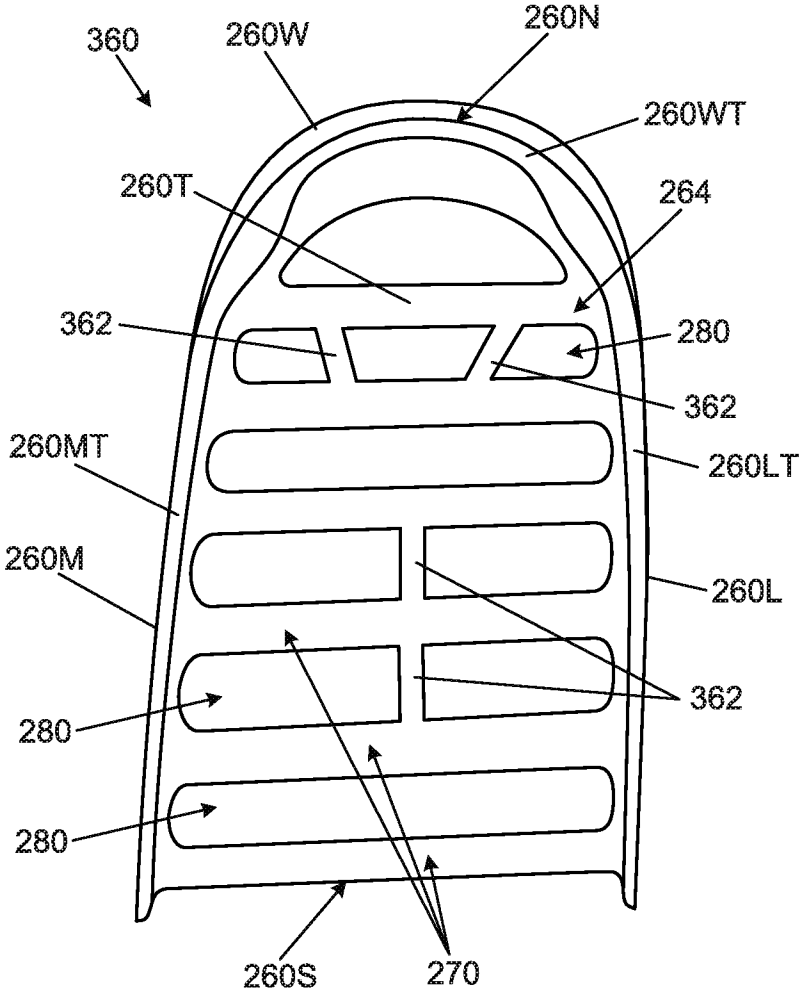
FIG. 4A illustrates an example foot support component (or portion thereof) including foot support members joined in their central areas and/or other areas.

FIG. 4B illustrates another example of a foot support component in the form of a midsole component 460 similar to those described above for midsole component 260. The midsole component 460 of FIG. 4B may have any of the various features, characteristics, materials, parts, and/or properties of the midsole components 260 and 360 described above. Thus, when the same reference number is used in FIG. 4B as used in the other figures, the same or similar parts are intended, and much of the repetitive disclosure is omitted.

In the example of FIG. 4B, however, one or more of the individual foot support members/slats 270 of the midsole component 460 include gaps 462 along their longest dimension (e.g., breadth dimension). The gap(s) 462 extend between and connect adjacent open spaces 280 together. The gaps 462 may be located any place along the longest (e.g., breadth) dimensions of the foot support members/slats 270, and the gaps 462 may extend across the foot support members/slats 270 in any direction. In some examples, a gap 462 may be located in the central area of the foot support members/slats 270 and/or positioned at a local extrema 270E of an arched foot support member/slat 270. Additionally or alternatively, one or more gaps 462 may be located outside the central area of the foot support members/slats 270 and/or positioned away from the local extrema 270E of an arched foot support member/slat 270. The gap(s) 462 may be integrally formed as part of the midsole component 460 (e.g., when the midsole component 460 is molded) and/or they may be cut across the foot support member/slat 270 after it is formed. Thus, the term "gap" as used herein in this context may constitute a discontinuity in foot support member/slat 270 (having little or no measurable separation).

While FIG. 4B shows gaps 462 connecting four pair of adjacent spaces 280, any number of gaps 462 may be included in an individual midsole component 460 connecting any number of pair of adjacent spaces 280. Additionally, while not required, as shown in the example of FIG. 4B, an individual midsole component 460 may include one or more gaps 462 and one or more bridge components 362, e.g., of the types described above in conjunction with FIG. 4A. One or more gaps 462 of these types (and, if present, one or more bridge components 362 of these types) may be included in the midsole component 460 structure to allow further tuning, customization, and/or optimization of the impact force attenuation response of the midsole component 460, the foot support component 250 containing it, and/or the sole structure 204 containing it. As an example, one or more gaps 462 may be provided at local areas of the midsole component 460 to provide increased flexibility and/or deflection at that local area (e.g., at area(s) identified from foot force measurement(s) as requiring increased deflection or softness).

Figure 5:
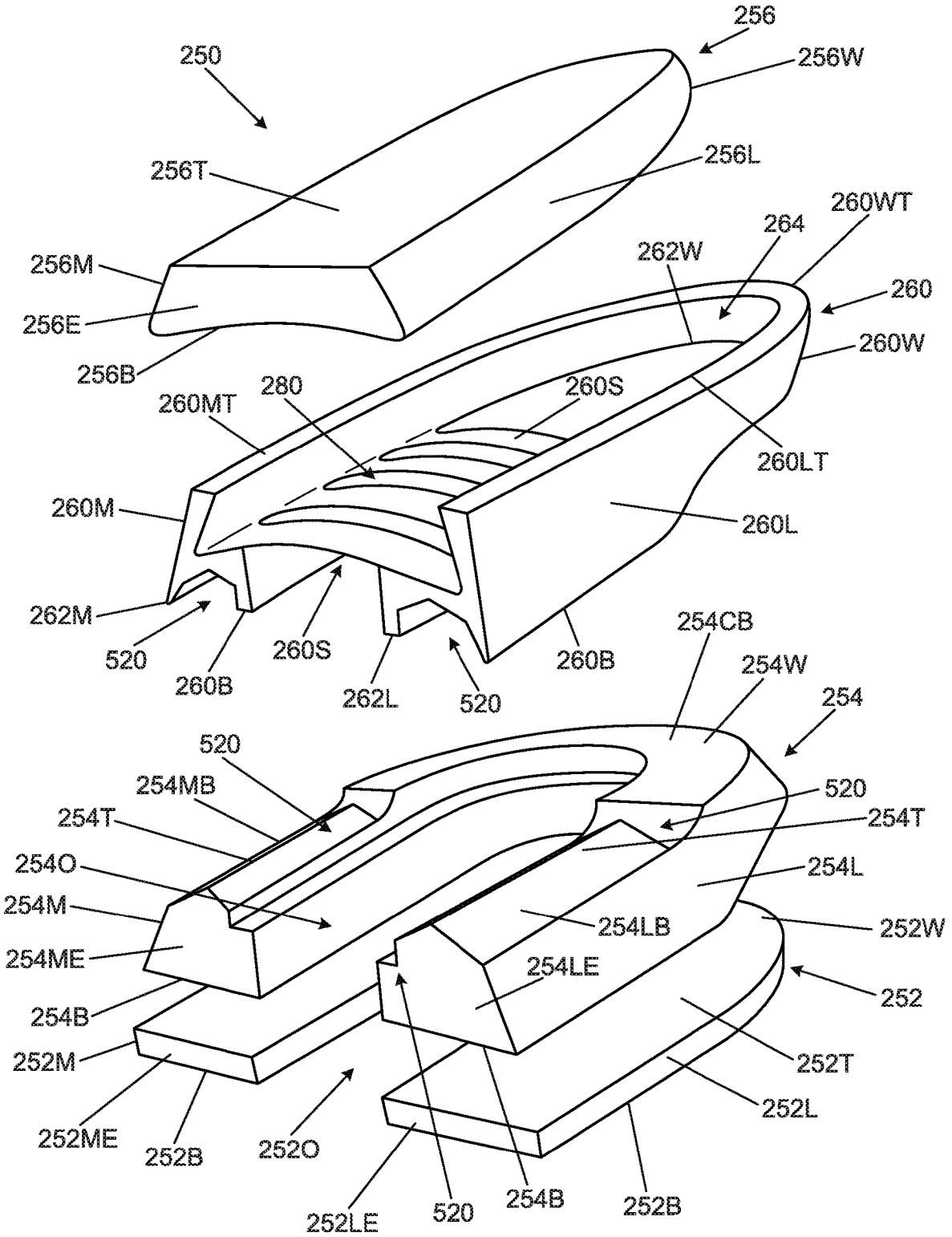
FIG. 5 provides an exploded view of a heel area and/or heel components of another example of foot support components and/or sole structures in accordance with some examples of this technology.

FIG. 5 is an exploded view of a foot support component 250 and a portion of a sole structure 204 similar to a portion of the view shown in FIG. 2A. Thus, when the same reference number is used in FIG. 5 as used in the other figures, the same or similar parts are intended, and much of the repetitive disclosure is omitted. The view of FIG. 5 is provided to illustrate features that may be included in at least some examples of this technology. As shown, at least a portion of the top surface 254T of the lower midsole component 254 and/or at least a portion of the bottom surface 260B of the base support surface 260S of the midsole component 260 may include structure to help hold the two components 254, 260 together. For example, under shear forces (e.g., when a user applies a sideways oriented force to the sole structure 204/shoe 200 e.g., when making a cutting action or turn), components 254, 260 may be exposed to forces that might tend to make them disengage (slide/tear apart, even when attached by an adhesive or in another manner). Thus, some portion(s) of the top surface 254T of the lower midsole component 254 and/or the bottom surface 260B of the base support surface 260S of the midsole component 260 may include mating and/or interlocking structures/surfaces 520. As some more specific examples, any one or more (and optionally all) of: (a) the lateral base edge 262L (e.g., a lower lateral edge) of the lateral sidewall 260L, (b) the medial base edge 262M (e.g., a lower medial edge) of the medial sidewall 260M, (c) the connecting base edge 262W (e.g., a lower edge) of the connecting wall 260W, (d) the lateral base edge 254LB (e.g., an upper edge) of the lower midsole component 254, (e) the medial base edge 254MB (e.g., an upper edge) of the lower midsole component 254, and/or (f) the connecting base edge 254CB (e.g., an upper edge) of the lower midsole component 254 may include mating and/or interlocking structures 520 (e.g., complementary engaging structures) that provide load bearing surface(s) in the side-to-side direction to help prevent the components 254, 260 from separating under shear forces. FIG. 5 (as well as FIG. 2A) illustrates various notches, raised ribs, and/or side surfaces along the top surface 254T of the lateral base edge 254LB and the medial base edge 254MB of the lower midsole component 254 as mating and/or interlocking structures 520 that may engage corresponding (e.g., complementary) raised ribs, notches, and/or side surfaces (as mating and/or interlocking structures 520) provided on the lateral base edge 262L and the medial base edge 262M, respectively, of the midsole component 260. The mating and/or interlocking structures 520 (e.g., raised ribs, notches, and/or side surfaces) also increase the surface area to which adhesive may be applied, to thereby increase the bonded surface area between the two components 254, 260.

In the specific examples described above, the midsole component 260 of the foot support component 250 and the sole structure 204 is located primarily in a heel region of the article of footwear, although other options are mentioned. As some more specific examples, if desired, the forwardmost ends of the lateral wall 260L and the medial wall 260M may be located rearward of a plane perpendicular to the longitudinal direction L of the overall foot support component 250, sole structure 204, and/or article of footwear 200 and located at P=0.45L (and in some examples, rearward of a perpendicular plane located at P=0.4L or even rearward of a perpendicular plane located at P=0.35L).

Figure 6:
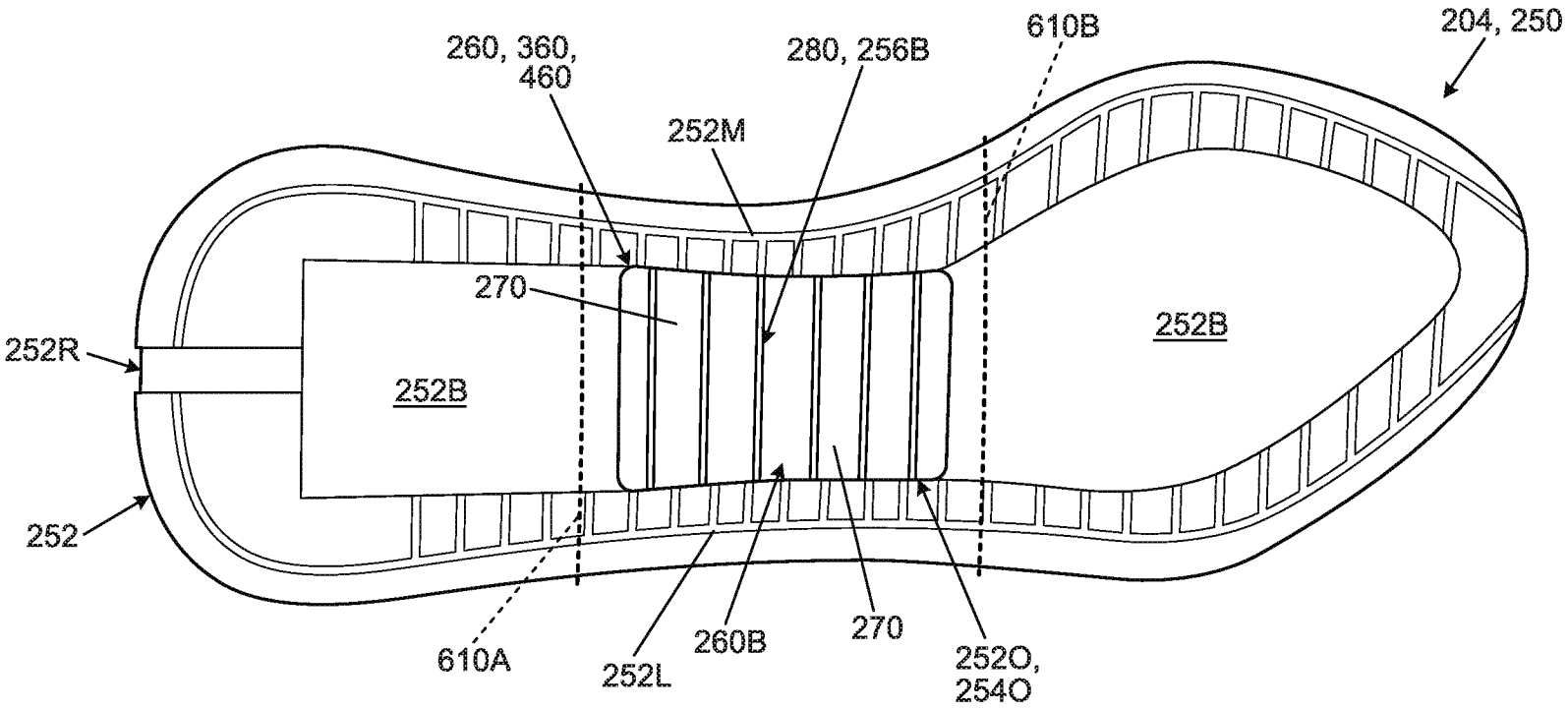
FIG. 6 illustrates an example of a midfoot/arch located foot support component in accordance with some examples of this technology.

Other arrangements of a foot support component 260, 360, 460 (e.g., midsole component 260, 360, 460) are possible in accordance with aspects of this technology, e.g., depending on where support is needed/desired. For example, as shown in FIG. 6, a midsole component 260, 360, 460 could be provided as a midfoot or arch support component. As more specific examples, the midsole component 260, 360, 460 may be located between planes perpendicular to the longitudinal direction L of the overall foot support component 250, sole structure 204, and/or article of footwear 200 and located at P=0.2L and P=0.8L. Thus, the rearwardmost extent of the midsole component 260, 360, 460 of this example (shown at broken line 610A in FIG. 6) may be located forward of a perpendicular plane located at P=0.2L, and in some examples, forward of a perpendicular plane located at P=0.25L, or even forward of a perpendicular plane located at P=0.3L. Additionally or alternatively, the forwardmost extent of the midsole component 260, 360, 460 of this example (shown at broken line 610B in FIG. 6) may be located rearward of a perpendicular plane located at P=0.8L, and in some examples, rearward of a perpendicular plane located at P=0.75L, or even rearward of a perpendicular plane located at P=0.7L. Portions of the bottom surface 260B of the midsole component 260, 360, 460 at the rearwardmost extent and the forwardmost extent (and/or around the periphery thereof) may be covered by the lower midsole component 254 and/or the outsole component 252 in at least some examples of this midfoot/arch based structure.

The midsole component 260, 360, 460 of the example of FIG. 6 may include a lateral sidewall (e.g., like 260L), a medial sidewall (e.g., like 260M), a receptacle, and a slatted or other base surface 260S of the types described above. In this midfoot/arch based example, however, a substantial connecting wall (akin to wall 260W) may be omitted, e.g., to avoid a raised wall running across the plantar surface of a wearer's foot. One or both of the outsole component 252 and/or the lower midsole component 254 may include central openings 252O, 254O, if desired, so that the bottom 260B of the midsole component 260, 360, 460 (e.g., the foot support member(s)/slat(s) 270 and/or space(s) 280) are exposed at the bottom exterior of the overall sole structure 204, as shown in FIG. 6. Also, the sidewall height dimension(s) HW may be somewhat toward the lower end of the various ranges described above (e.g., less than 15 mm high, less than 12 mm high, less than 10 mm high, etc.).

Figure 7:
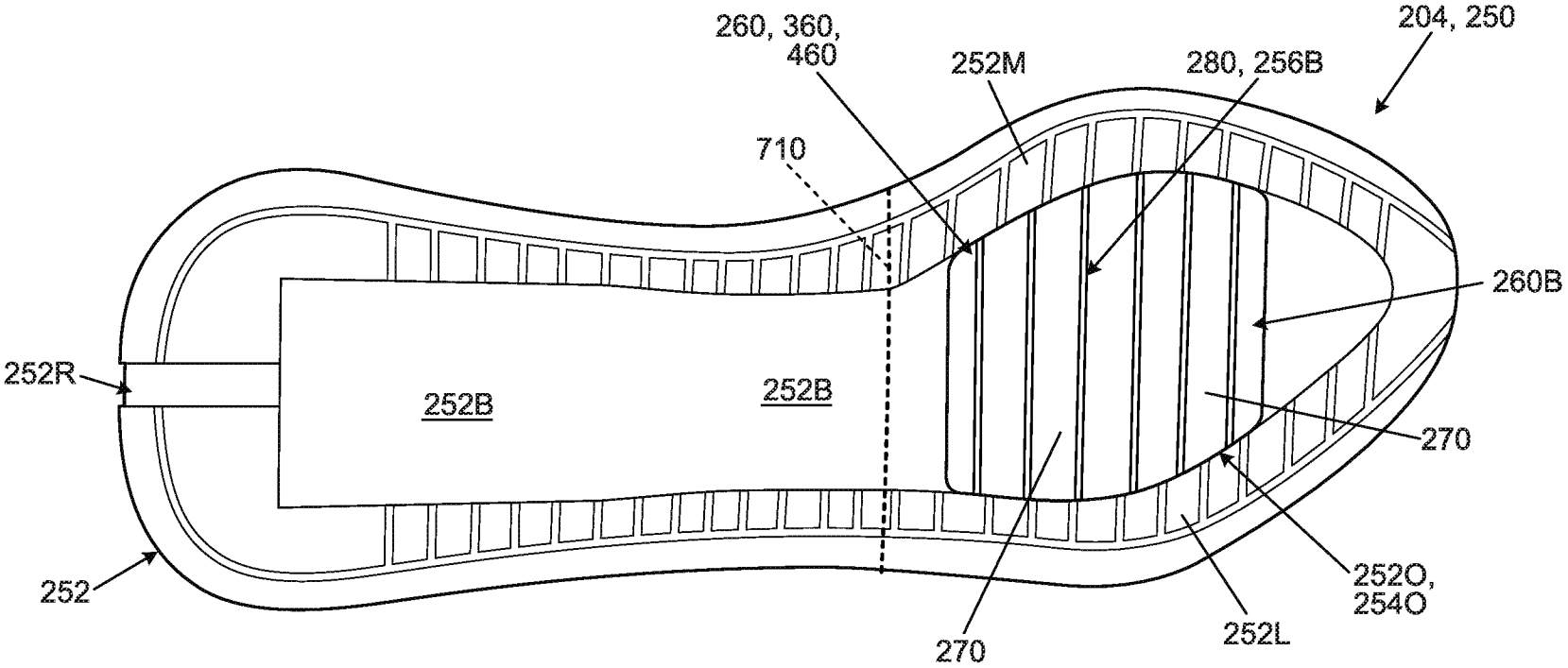
FIG. 7 illustrates an example of a forefoot located foot support component in accordance with some examples of this technology.

FIG. 7 illustrates a forefoot based arrangement of a foot support component 260, 360, 460 in accordance with aspects of this technology. As more specific examples, the midsole component 260, 360, 460 of this example may be located forward of a plane perpendicular to the longitudinal direction L of the overall foot support component 250, sole structure 204, and/or article of footwear 200 and located at P=0.55L. Thus, the rearwardmost extent of the midsole component 260, 360, 460 of this example (shown at broken line 710 in FIG. 7) may be located forward of a perpendicular plane located at P=0.55L, and in some examples, forward of a perpendicular plane located at P=0.6L, or even forward of a perpendicular plane located at P=0.65L. Portions of the bottom surface 260B of the midsole component 260, 360, 460 at the rearwardmost extent and/or around the periphery thereof may be covered by the lower midsole component 254 and/or the outsole component 252 in at least some examples of this forefoot based structure.

This example midsole component 260, 360, 460 may include a lateral sidewall (e.g., like 260L), a medial sidewall (e.g., like 260M), a receptacle, and a slatted or other base surface 260S of the types described above. In this forefoot based example, if desired, a forward connecting wall (akin to wall 260W) may be located around the forward toe area of the structure to connect the lateral sidewall 260L and the medial sidewall 260M. When present, this forward connecting wall may have any of the structural features, properties, options, and the like of the connecting wall 260W described above, including the notch features and/or other pre-bend/flexion supporting features, except that it is located around the front of the foot support structure rather than around the rear of the structure. One or both of the outsole component 252 and/or the lower midsole component 254 may include central openings 252O, 254O, if desired (and may be U-shaped), so that the bottom 260B of the midsole component 260, 360, 460 (e.g., the foot support member(s)/slat(s) 270 and/or space(s) 280) are exposed at the bottom exterior of the overall sole structure 204, as shown in FIG. 7. Also, the sidewall height dimension(s) HW may be within the various ranges described above, and in some specific examples, less than 20 mm, less than 15 mm high, less than 12 mm high, less than 10 mm high, etc. If desired, the sidewall(s) 260L, 260M, and/or 260W may extend to locations over the top of the wearer's foot (inside or outside the footwear upper) to provide a toe cap like structure.

Figure 8:
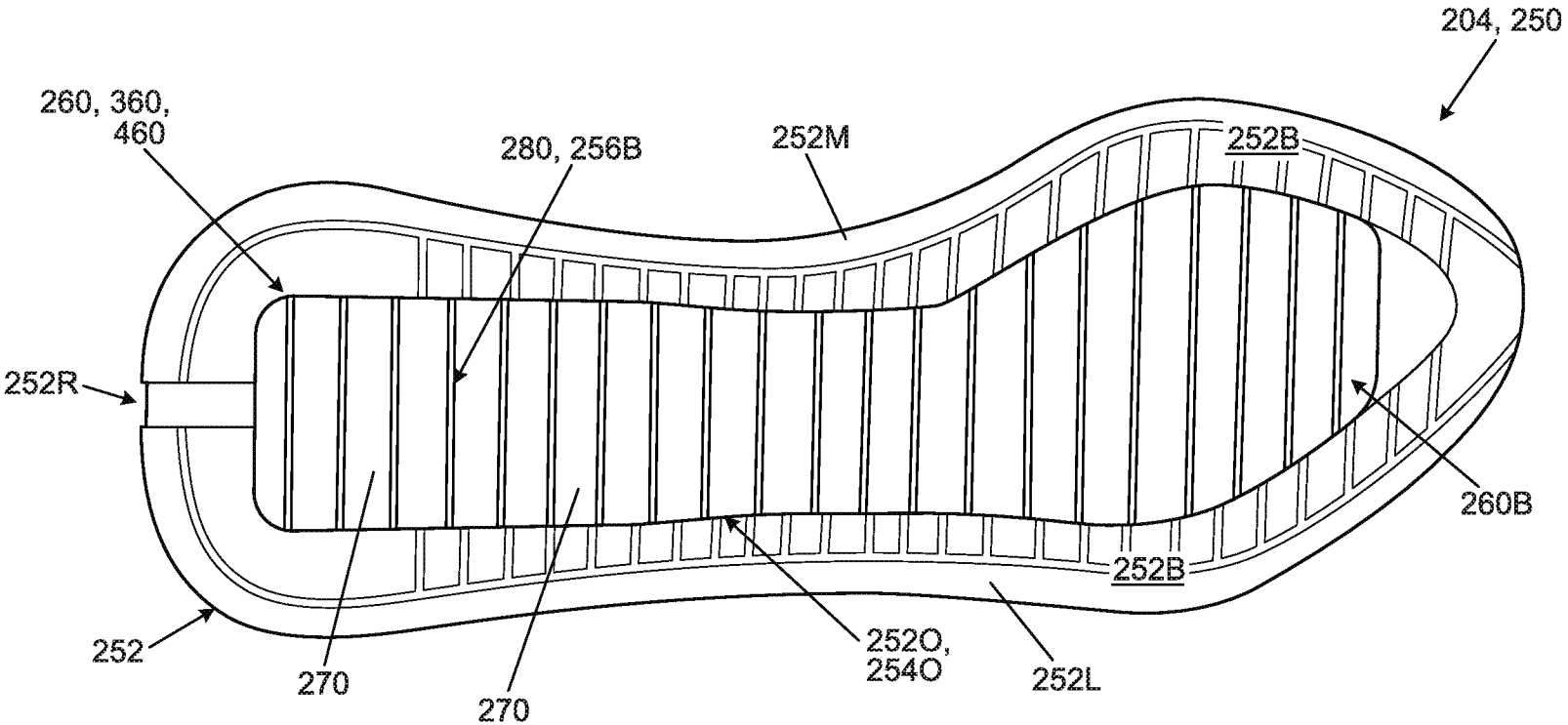
FIG. 8 illustrates an example of a full foot support component in accordance with some examples of this technology.

Still other arrangements and/or extents of the midsole component 260, 360, 460 are possible without departing from this technology. FIG. 8 shows an arrangement in which the midsole component 260, 360, 460 extends to support all or substantially all of the plantar surface of a wearer's foot. This example midsole component 260, 360, 460 may include a lateral sidewall (e.g., like 260L), a medial sidewall (e.g., like 260M), a receptacle, and a slatted or other base surface 260S of the types described above. In this full foot based example, if desired, a forward connecting wall (akin to wall 260W) may be located around the forward toe area of the structure to connect the lateral sidewall 260L and the medial sidewall 260M and/or a rearward connecting wall (akin to wall 260W) may be located around the rear heel area of the structure to connect the lateral sidewall 260L and the medial sidewall 260M. When present, the connecting wall(s) may have any of the structural features, properties, options, and the like of the connecting wall 260W described above, including one or more notched areas, e.g., to promote/support bending of the lateral side with respect to the medial side. One or both of the outsole component 252 and/or the lower midsole component 254 may include central openings 252O, 254O, if desired, so that the bottom 260B of the midsole component 260, 360, 460 (e.g., the foot support member(s)/slat(s) 270 and/or space(s) 280) are exposed at the bottom exterior of the overall sole structure 204. Portions of the bottom surface 260B of the midsole component 260, 360, 460, e.g., around the periphery thereof, may be covered by the lower midsole component 254 and/or the outsole component 252 in at least some examples of this structure.

As still other examples, if desired, the midsole component 260, 360, 460 may be sized and arranged in a foot support component 250 structure to support: (a) the combined midfoot and heel areas of a wearer's foot, (b) the combined midfoot and forefoot areas of a wearer's foot, and/or (c) the combined heel and forefoot areas of a wearer's foot.

While the above example structures show arched foot support members/slats 270 with a single local extrema 270E, other options are possible, including: (a) flat/planar foot support members/slats 270 (optionally oriented horizontal when the midsole component 260 and/or sole structure are supported on a horizontal base surface in an unloaded condition); (b) foot support members/slats 270 with two local extrema 270E or peaks; (c) foot support members/slats 270 with three local extrema 270E or peaks; and/or (d) foot support members/slats 270 with four or more local extrema 270E or peaks.

III. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes at least the subject matter described in the following numbered Clauses:

Clause 1. A foot support component for an article of footwear, comprising:

a lateral sidewall that extends to and forms a lateral free edge;

a medial sidewall located opposite the lateral sidewall, wherein the medial sidewall extends to and forms a medial free edge; and a base support surface that includes an exterior surface and an interior surface opposite the exterior surface, wherein the base support surface includes:

a first arched foot support slat, wherein a local extrema of the first arched foot support slat is located in a central area of the first arched foot support slat between the lateral sidewall and the medial sidewall, and wherein the first arched foot support slat originates at or proximate to the lateral sidewall and the medial sidewall at locations spaced away from the lateral free edge and the medial free edge, a second arched foot support slat, wherein a local extrema of the second arched foot support slat is located in a central area of the second arched foot support slat between the lateral sidewall and the medial sidewall, and wherein the second arched foot support slat originates at or proximate to the lateral sidewall and the medial sidewall at locations spaced away from the lateral free edge and the medial free edge, a third arched foot support slat, wherein a local extrema of the third arched foot support slat is located in a central area of the third arched foot support slat between the lateral sidewall and the medial sidewall, and wherein the third arched foot support slat originates at or proximate to the lateral sidewall and the medial sidewall at locations spaced away from the lateral free edge and the medial free edge, a first open space extending between and separating at least 90% of a rearward edge of the first arched foot support slat from at least 90% of a forward edge of the second arched foot support slat, and a second open space extending between and separating at least 90% of a rearward edge the second arched foot support slat from at least 90% of a forward edge of the third arched foot support slat, wherein each of the first open space and the second open space constitutes a through hole extending completely through the base support surface from the exterior surface of the base support surface to the interior surface of the base support surface.

Clause 2. The foot support component according to Clause 1, further comprising: a connecting wall connecting the lateral sidewall and the medial sidewall, wherein the connecting wall extends to and forms a connecting wall free edge that extends from the lateral free edge to the medial free edge.

Clause 3. The foot support component according to Clause 2, wherein the connecting wall free edge includes a notched or concave top edge portion.

Clause 4. The foot support component according to Clause 2, wherein the connecting wall includes a notched or concave portion.

Clause 5. The foot support component according to any one of Clauses 2 to 4, wherein the connecting wall is a rear heel wall.

Clause 6. The foot support component according to any one of Clauses 2 to 4, wherein the connecting wall is a forward toe wall.

Clause 7. The foot support component according to any one of Clauses 2 to 6, wherein the exterior surface of the base support surface includes a lateral base edge located on an opposite side of the lateral sidewall from the lateral free edge, a medial base edge located on an opposite side of the medial sidewall from the medial free edge, and a connecting base edge located on an opposite side of the connecting wall from the connecting wall free edge.

Clause 8. The foot support component according to Clause 7, further comprising:

a first midsole system including a lateral base edge, a medial base edge, and a connecting base edge, wherein the lateral base edge of the first midsole system is engaged with the lateral base edge of the base support surface, wherein the medial base edge of the first midsole system is engaged with the medial base edge of the base support surface, and wherein the connecting base edge of the first midsole system is engaged with the connecting base edge of the base support surface.

Clause 9. The foot support component according to Clause 8, wherein the first midsole system has a U-shaped structure in which the lateral base edge of the first midsole system forms a lateral arm of the U-shaped structure, the medial base edge of the first midsole system forms a medial arm of the U-shaped structure, and the connecting base edge of the first midsole system forms a base of the U-shaped structure.

Clause 10. The foot support component according to any one of Clauses 2 to 6, wherein an interior surface of the lateral sidewall, an interior surface of the medial sidewall, an interior surface of the connecting wall, and the interior surface of the base support surface define a receptacle.

Clause 11. The foot support component according to any one of Clauses 1 to 6, wherein an interior surface of the lateral sidewall, an interior surface of the medial sidewall, and the interior surface of the base support surface define a receptacle.

Clause 12. The foot support component according to Clause 10 or Clause 11, further comprising:

a midsole component received in the receptacle.

Clause 13. The foot support component according to Clause 12, wherein the exterior surface of the base support surface includes a lateral base edge located on an opposite side of the lateral sidewall from the lateral free edge and a medial base edge located on an opposite side of the medial sidewall from the medial free edge.

Clause 14. The foot support component according to Clause 13, further comprising:

a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 15. The foot support component according to Clause 14, wherein a material of the midsole component has a lower Shore A hardness and/or a lower density than a Shore A hardness and/or density of a material of the first midsole system.

Clause 16. The foot support component according to Clause 14 or Clause 15, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 17. The foot support component according to any one of Clauses 1 to 6, wherein the exterior surface of the base support surface includes a lateral base edge located on an opposite side of the lateral sidewall from the lateral free edge and a medial base edge located on an opposite side of the medial sidewall from the medial free edge.

Clause 18. The foot support component according to Clause 17, further comprising:

a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 19. The foot support component according to Clause 18, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 20. The foot support component according to any one of Clauses 8, 9, 14, 15, 16, 18, or 19, further comprising:

an outsole system including a lateral outsole element engaged with a surface of the first midsole system located opposite the lateral base edge and a medial outsole element engaged with a surface of the first midsole system located opposite the medial base edge.

Clause 21. The foot support component according to any one of Clauses 8, 9, 14, 15, 16, 18, 19, or 20, wherein at least a portion of each of the first arched foot support slat, the second arched foot support slat, and the third arched foot support slat is exposed between the lateral base edge of the first midsole system and the medial base edge of the first midsole system.

Clause 22. A foot support component for an article of footwear, comprising:

a lateral sidewall that extends to and forms a lateral free edge;

a medial sidewall located opposite the lateral sidewall, wherein the medial sidewall extends to and forms a medial free edge; and a base support surface that includes an exterior surface and an interior surface opposite the exterior surface, wherein the base support surface includes:

a first arched foot support member that includes a first forward edge extending between: (i) a first lateral origination point located at or proximate to the lateral sidewall and (ii) a first medial origination point located at or proximate to the medial sidewall and a first rearward edge extending between: (i) a second lateral origination point located at or proximate to the lateral sidewall and (ii) a second medial origination point located at or proximate to the medial sidewall, and wherein the first arched foot support member includes a first single local extrema located in a central area of the first arched foot support member between the lateral sidewall and the medial sidewall, a second arched foot support member that includes a second forward edge extending between: (i) a third lateral origination point located at or proximate to the lateral sidewall and (ii) a third medial origination point located at or proximate to the medial sidewall and a second rearward edge extending between: (i) a fourth lateral origination point located at or proximate to the lateral sidewall and (ii) a fourth medial origination point located at or proximate to the medial sidewall, and wherein the second arched foot support member includes a second single local extrema located in a central area of the second arched foot support member between the lateral sidewall and the medial sidewall, wherein the second forward edge is substantially parallel with the first rearward edge, and wherein the second forward edge is separated from the first rearward edge over at least 85% of a breadth dimension of the second arched foot support member, and a third arched foot support member that includes a third forward edge extending between: (i) a fifth lateral origination point located at or proximate to the lateral sidewall and (ii) a fifth medial origination point located at or proximate to the medial sidewall and a third rearward edge extending between: (i) a sixth lateral origination point located at or proximate to the lateral sidewall and (ii) a sixth medial origination point located at or proximate to the medial sidewall, and wherein the third arched foot support member includes a third single local extrema located in a central area of the third arched foot support member between the lateral sidewall and the medial sidewall, wherein the third forward edge is substantially parallel with the second rearward edge, and wherein the third forward edge is separated from the second rearward edge over at least 85% of a breadth dimension of the third arched foot support member.

Clause 23. The foot support component according to Clause 22, further comprising: a connecting wall connecting the lateral sidewall and the medial sidewall, wherein the connecting wall extends to and forms a connecting wall free edge that extends from the lateral free edge to the medial free edge.

Clause 24. The foot support component according to Clause 23, wherein the connecting wall free edge includes a notched or concave top edge portion.

Clause 25. The foot support component according to Clause 23, wherein the connecting wall includes a notched or concave portion.

Clause 26. The foot support component according to any one of Clauses 23 to 25, wherein the connecting wall is a rear heel wall.

Clause 27. The foot support component according to any one of Clauses 23 to 25, wherein the connecting wall is a forward toe wall.

Clause 28. The foot support component according to any one of Clauses 23 to 27, wherein the exterior surface of the base support surface includes a lateral base edge located on an opposite side of the lateral sidewall from the lateral free edge, a medial base edge located on an opposite side of the medial sidewall from the medial free edge, and a connecting base edge located on an opposite side of the connecting wall from the connecting wall free edge.

Clause 29. The foot support component according to Clause 28, further comprising:

a first midsole system including a lateral base edge, a medial base edge, and a connecting base edge, wherein the lateral base edge of the first midsole system is engaged with the lateral base edge of the base support surface, wherein the medial base edge of the first midsole system is engaged with the medial base edge of the base support surface, and wherein the connecting base edge of the first midsole system is engaged with the connecting base edge of the base support surface.

Clause 30. The foot support component according to Clause 29, wherein the first midsole system has a U-shaped structure in which the lateral base edge of the first midsole system forms a lateral arm of the U-shaped structure, the medial base edge of the first midsole system forms a medial arm of the U-shaped structure, and the connecting base edge of the first midsole system forms a base of the U-shaped structure.

Clause 31. The foot support component according to any one of Clauses 23 to 27, wherein an interior surface of the lateral sidewall, an interior surface of the medial sidewall, an interior surface of the connecting wall, and the interior surface of the base support surface define a receptacle.

Clause 32. The foot support component according to any one of Clauses 22 to 27, wherein an interior surface of the lateral sidewall, an interior surface of the medial sidewall, and the interior surface of the base support surface define a receptacle.

Clause 33. The foot support component according to Clause 31 or Clause 32, further comprising:

a midsole component received in the receptacle.

Clause 34. The foot support component according to Clause 33, wherein the exterior surface of the base support surface includes a lateral base edge located on an opposite side of the lateral sidewall from the lateral free edge and a medial base edge located on an opposite side of the medial sidewall from the medial free edge.

Clause 35. The foot support component according to Clause 34, further comprising:

a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 36. The foot support component according to Clause 35, wherein a material of the midsole component has a lower Shore A hardness and/or a lower density than a Shore A hardness and/or density of a material of the first midsole system.

Clause 37. The foot support component according to Clause 35 or Clause 36, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 38. The foot support component according to any one of Clauses 22 to 27, wherein the exterior surface of the base support surface includes a lateral base edge located on an opposite side of the lateral sidewall from the lateral free edge and a medial base edge located on an opposite side of the medial sidewall from the medial free edge.

Clause 39. The foot support component according to Clause 38, further comprising: a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 40. The foot support component according to Clause 39, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 41. The foot support component according to any one of Clauses 29, 30, 35, 36, 37, 39, or 40, further comprising:

an outsole system including a lateral outsole element engaged with a surface of the first midsole system located opposite the lateral base edge and a medial outsole element engaged with a surface of the first midsole system located opposite the medial base edge.

Clause 42. The foot support component according to any one of Clauses 29, 30, 35, 36, 37, 39, 40, or 41, wherein at least a portion of each of the first arched foot support member, the second arched foot support member, and the third arched foot support member is exposed between the lateral base edge of the first midsole system and the medial base edge of the first midsole system.

Clause 43. The foot support component according to any one of Clauses 22 to 42, wherein at least one of the first arched foot support member, the second arched foot support member, and the third arched foot support member includes a gap along its breadth dimension.

Clause 44. The foot support component according to any one of Clauses 22 to 43, wherein: (a) a bridge member extends between and connects a portion of the first rearward edge with a portion of the second forward edge, and/or (b) a bridge component extends between and connects a portion of the second rearward edge with a portion of the third forward edge.

Clause 45. An article of footwear, comprising:

an upper; and a sole structure engaged with the upper, wherein the sole structure includes a foot support component according to any preceding Clause.

Clause 46. A foot support component for an article of footwear, comprising:

a lateral sidewall that extends to and forms a lateral free edge;

a medial sidewall located opposite the lateral sidewall, wherein the medial sidewall extends to and forms a medial free edge; and a base support surface that includes an exterior surface and an interior surface opposite the exterior surface, wherein the base support surface includes:

a first foot support slat extending in a direction between the lateral sidewall and the medial sidewall, and wherein the first foot support slat originates at or proximate to the lateral sidewall and the medial sidewall at locations spaced away from the lateral free edge and the medial free edge, a second foot support slat extending in a direction between the lateral sidewall and the medial sidewall, and wherein the second foot support slat originates at or proximate to the lateral sidewall and the medial sidewall at locations spaced away from the lateral free edge and the medial free edge, a third foot support slat extending in a direction between the lateral sidewall and the medial sidewall, and wherein the third foot support slat originates at or proximate to the lateral sidewall and the medial sidewall at locations spaced away from the lateral free edge and the medial free edge, a first open space extending between and separating at least 90% of a rearward edge of the first foot support slat from at least 75% of a forward edge of the second foot support slat, and a second open space extending between and separating at least 90% of a rearward edge the second foot support slat from at least 75% of a forward edge of the third foot support slat.

Clause 47. The foot support component according to Clause 46, further comprising:

a connecting wall connecting the lateral sidewall and the medial sidewall, wherein the connecting wall extends to and forms a connecting wall free edge that extends from the lateral free edge to the medial free edge.

Clause 48. The foot support component according to Clause 47, wherein the connecting wall free edge includes a notched or concave top edge portion.

Clause 49. The foot support component according to Clause 47, wherein the connecting wall includes a notched or concave portion.

Clause 50. The foot support component according to any one of Clauses 47 to 49, wherein the connecting wall is a rear heel wall.

Clause 51. The foot support component according to any one of Clauses 47 to 49, wherein the connecting wall is a forward toe wall.

Clause 52. The foot support component according to any one of Clauses 47 to 51, wherein the exterior surface of the base support surface includes a lateral base edge located on an opposite side of the lateral sidewall from the lateral free edge, a medial base edge located on an opposite side of the medial sidewall from the medial free edge, and a connecting base edge located on an opposite side of the connecting wall from the connecting wall free edge.

Clause 53. The foot support component according to Clause 52, further comprising:

a first midsole system including a lateral base edge, a medial base edge, and a connecting base edge, wherein the lateral base edge of the first midsole system is engaged with the lateral base edge of the base support surface, wherein the medial base edge of the first midsole system is engaged with the medial base edge of the base support surface, and wherein the connecting base edge of the first midsole system is engaged with the connecting base edge of the base support surface.

Clause 54. The foot support component according to Clause 53, wherein the first midsole system has a U-shaped structure in which the lateral base edge of the first midsole system forms a lateral arm of the U-shaped structure, the medial base edge of the first midsole system forms a medial arm of the U-shaped structure, and the connecting base edge of the first midsole system forms a base of the U-shaped structure.

Clause 55. The foot support component according to any one of Clauses 47 to 51, wherein an interior surface of the lateral sidewall, an interior surface of the medial sidewall, an interior surface of the connecting wall, and the interior surface of the base support surface define a receptacle.

Clause 56. The foot support component according to any one of Clauses 46 to 51, wherein an interior surface of the lateral sidewall, an interior surface of the medial sidewall, and the interior surface of the base support surface define a receptacle.

Clause 57. The foot support component according to Clause 55 or Clause 56, further comprising:

a midsole component received in the receptacle.

Clause 58. The foot support component according to Clause 57, wherein the exterior surface of the base support surface includes a lateral base edge located on an opposite side of the lateral sidewall from the lateral free edge and a medial base edge located on an opposite side of the medial sidewall from the medial free edge.

Clause 59. The foot support component according to Clause 58, further comprising:

a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 60. The foot support component according to Clause 59, wherein a material of the midsole component has a lower Shore A hardness and/or a lower density than a Shore A hardness and/or density of a material of the first midsole system.

Clause 61. The foot support component according to Clause 59 or Clause 60, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 62. The foot support component according to any one of Clauses 46 to 51, wherein the exterior surface of the base support surface includes a lateral base edge located on an opposite side of the lateral sidewall from the lateral free edge and a medial base edge located on an opposite side of the medial sidewall from the medial free edge.

Clause 63. The foot support component according to Clause 62, further comprising:

a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 64. The foot support component according to Clause 63, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 65. The foot support component according to any one of Clauses 53, 54, 59, 60, 61, 63, or 64, further comprising:

an outsole system including a lateral outsole element engaged with a surface of the first midsole system located opposite the lateral base edge and a medial outsole element engaged with a surface of the first midsole system located opposite the medial base edge.

Clause 66. The foot support component according to any one of Clauses 53, 54, 59, 60, 61, 63, 64, or 65, wherein at least a portion of each of the first foot support slat, the second foot support slat, and the third foot support slat is exposed between the lateral base edge of the first midsole system and the medial base edge of the first midsole system.

Clause 67. A foot support component for an article of footwear, comprising:

a lateral sidewall that extends to and forms a lateral free edge;

a medial sidewall located opposite the lateral sidewall, wherein the medial sidewall extends to and forms a medial free edge; and a base support surface that includes an exterior surface and an interior surface opposite the exterior surface, wherein the base support surface includes:

a first foot support member that includes a first forward edge extending between: (i) a first lateral origination point located at or proximate to the lateral sidewall and (ii) a first medial origination point located at or proximate to the medial sidewall and a first rearward edge extending between: (i) a second lateral origination point located at or proximate to the lateral sidewall and (ii) a second medial origination point located at or proximate to the medial sidewall, a second foot support member that includes a second forward edge extending between: (i) a third lateral origination point located at or proximate to the lateral sidewall and (ii) a third medial origination point located at or proximate to the medial sidewall and a second rearward edge extending between: (i) a fourth lateral origination point located at or proximate to the lateral sidewall and (ii) a fourth medial origination point located at or proximate to the medial sidewall, and a third foot support member that includes a third forward edge extending between: (i) a fifth lateral origination point located at or proximate to the lateral sidewall and (ii) a fifth medial origination point located at or proximate to the medial sidewall and a third rearward edge extending between: (i) a sixth lateral origination point located at or proximate to the lateral sidewall and (ii) a sixth medial origination point located at or proximate to the medial sidewall.

Clause 68. The foot support component according to Clause 67, further comprising:

a connecting wall connecting the lateral sidewall and the medial sidewall, wherein the connecting wall extends to and forms a connecting wall free edge that extends from the lateral free edge to the medial free edge.

Clause 69. The foot support component according to Clause 68, wherein the connecting wall free edge includes a notched or concave top edge portion.

Clause 70. The foot support component according to Clause 68, wherein the connecting wall includes a notched or concave portion.

Clause 71. The foot support component according to any one of Clauses 68 to 70, wherein the connecting wall is a rear heel wall.

Clause 72. The foot support component according to any one of Clauses 68 to 70, wherein the connecting wall is a forward toe wall.

Clause 73. The foot support component according to any one of Clauses 68 to 72, wherein the exterior surface of the base support surface includes a lateral base edge located on an opposite side of the lateral sidewall from the lateral free edge, a medial base edge located on an opposite side of the medial sidewall from the medial free edge, and a connecting base edge located on an opposite side of the connecting wall from the connecting wall free edge.

Clause 74. The foot support component according to Clause 73, further comprising:

a first midsole system including a lateral base edge, a medial base edge, and a connecting base edge, wherein the lateral base edge of the first midsole system is engaged with the lateral base edge of the base support surface, wherein the medial base edge of the first midsole system is engaged with the medial base edge of the base support surface, and wherein the connecting base edge of the first midsole system is engaged with the connecting base edge of the base support surface.

Clause 75. The foot support component according to Clause 74, wherein the first midsole system has a U-shaped structure in which the lateral base edge of the first midsole system forms a lateral arm of the U-shaped structure, the medial base edge of the first midsole system forms a medial arm of the U-shaped structure, and the connecting base edge of the first midsole system forms a base of the U-shaped structure.

Clause 76. The foot support component according to any one of Clauses 69 to 72, wherein an interior surface of the lateral sidewall, an interior surface of the medial sidewall, an interior surface of the connecting wall, and the interior surface of the base support surface define a receptacle.

Clause 77. The foot support component according to any one of Clauses 67 to 72, wherein an interior surface of the lateral sidewall, an interior surface of the medial sidewall, and the interior surface of the base support surface define a receptacle.

Clause 78. The foot support component according to Clause 76 or Clause 77, further comprising:

a midsole component received in the receptacle.

Clause 79. The foot support component according to Clause 78, wherein the exterior surface of the base support surface includes a lateral base edge located on an opposite side of the lateral sidewall from the lateral free edge and a medial base edge located on an opposite side of the medial sidewall from the medial free edge.

Clause 80. The foot support component according to Clause 69, further comprising:

a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 81. The foot support component according to Clause 80, wherein a material of the midsole component has a lower Shore A hardness and/or a lower density than a Shore A hardness and/or density of a material of the first midsole system.

Clause 82. The foot support component according to Clause 80 or Clause 81, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 83. The foot support component according to any one of Clauses 67 to 72, wherein the exterior surface of the base support surface includes a lateral base edge located on an opposite side of the lateral sidewall from the lateral free edge and a medial base edge located on an opposite side of the medial sidewall from the medial free edge.

Clause 84. The foot support component according to Clause 83, further comprising:

a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

Clause 85. The foot support component according to Clause 84, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

Clause 86. The foot support component according to any one of Clauses 74, 75, 80, 81, 82, 84, or 85, further comprising:

an outsole system including a lateral outsole element engaged with a surface of the first midsole system located opposite the lateral base edge and a medial outsole element engaged with a surface of the first midsole system located opposite the medial base edge.

Clause 87. The foot support component according to any one of Clauses 74, 75, 80, 81, 82, 84, 84, 85, or 86, wherein at least a portion of each of the first foot support member, the second foot support member, and the third foot support member is exposed between the lateral base edge of the first midsole system and the medial base edge of the first midsole system.

Clause 88. The foot support component according to any one of Clauses 67 to 87, wherein at least one of the first foot support member, the second foot support member, and the third foot support member includes a gap along its breadth dimension.

Clause 89. The foot support component according to any one of Clauses 67 to 88, wherein: (a) a bridge member extends between and connects a portion of the first rearward edge with a portion of the second forward edge, and/or (b) a bridge component extends between and connects a portion of the second rearward edge with a portion of the third forward edge.

Clause 90. An article of footwear, comprising:

an upper; and a sole structure engaged with the upper, wherein the sole structure includes a foot support component according to any one of Clauses 46 to 89.

What is claimed is:

1. A foot support component for an article of footwear, comprising:

a lateral sidewall that extends to and forms a lateral free edge;

a medial sidewall located opposite the lateral sidewall, wherein the medial sidewall extends to and forms a medial free edge;

a base support surface that includes an exterior surface and an interior surface opposite the exterior surface, wherein the base support surface includes:

a first arched foot support slat, wherein a local extrema of the first arched foot support slat is located in a central area of the first arched foot support slat between the lateral sidewall and the medial sidewall, and wherein the first arched foot support slat originates at or proximate to the lateral sidewall and the medial sidewall at locations spaced away from the lateral free edge and the medial free edge, a second arched foot support slat, wherein a local extrema of the second arched foot support slat is located in a central area of the second arched foot support slat between the lateral sidewall and the medial sidewall, and wherein the second arched foot support slat originates at or proximate to the lateral sidewall and the medial sidewall at locations spaced away from the lateral free edge and the medial free edge, a third arched foot support slat, wherein a local extrema of the third arched foot support slat is located in a central area of the third arched foot support slat between the lateral sidewall and the medial sidewall, and wherein the third arched foot support slat originates at or proximate to the lateral sidewall and the medial sidewall at locations spaced away from the lateral free edge and the medial free edge, a first open space extending between and separating at least 90% of a rearward edge of the first arched foot support slat from at least 90% of a forward edge of the second arched foot support slat, and a second open space extending between and separating at least 90% of a rearward edge the second arched foot support slat from at least 90% of a forward edge of the third arched foot support slat, wherein each of the first open space and the second open space constitutes a through hole extending completely through the base support surface from the exterior surface of the base support surface to the interior surface of the base support surface; and a connecting wall connecting the lateral sidewall and the medial sidewall, wherein the connecting wall extends to and forms a connecting wall free edge that extends from the lateral free edge to the medial free edge.

2. The foot support component according to claim 1, wherein the connecting wall includes a notched or concave portion.

3. The foot support component according to claim 1, wherein the connecting wall is a rear heel wall.

4. The foot support component according to claim 1, wherein the exterior surface of the base support surface includes a lateral base edge located on an opposite side of the lateral sidewall from the lateral free edge, a medial base edge located on an opposite side of the medial sidewall from the medial free edge, and a connecting base edge located on an opposite side of the connecting wall from the connecting wall free edge, and wherein the foot support component further comprises:

a first midsole system including a lateral base edge, a medial base edge, and a connecting base edge, wherein the lateral base edge of the first midsole system is engaged with the lateral base edge of the base support surface, wherein the medial base edge of the first midsole system is engaged with the medial base edge of the base support surface, and wherein the connecting base edge of the first midsole system is engaged with the connecting base edge of the base support surface.

5. The foot support component according to claim 4, wherein the first midsole system has a U-shaped structure in which the lateral base edge of the first midsole system forms a lateral arm of the U-shaped structure, the medial base edge of the first midsole system forms a medial arm of the U-shaped structure, and the connecting base edge of the first midsole system forms a base of the U-shaped structure.

6. The foot support component according to claim 1, wherein an interior surface of the lateral sidewall, an interior surface of the medial sidewall, an interior surface of the connecting wall, and the interior surface of the base support surface define a receptacle.

7. The foot support component according to claim 1, wherein an interior surface of the lateral sidewall, an interior surface of the medial sidewall, and the interior surface of the base support surface define a receptacle.

8. The foot support component according to claim 7, further comprising:

a midsole component received in the receptacle.

9. A foot support component for an article of footwear, comprising:

a lateral sidewall that extends to and forms a lateral free edge;

a medial sidewall located opposite the lateral sidewall, wherein the medial sidewall extends to and forms a medial free edge;

a base support surface that includes an exterior surface and an interior surface opposite the exterior surface, wherein the base support surface includes:

a first arched foot support slat, wherein a local extrema of the first arched foot support slat is located in a central area of the first arched foot support slat between the lateral sidewall and the medial sidewall, and wherein the first arched foot support slat originates at or proximate to the lateral sidewall and the medial sidewall at locations spaced away from the lateral free edge and the medial free edge, a second arched foot support slat, wherein a local extrema of the second arched foot support slat is located in a central area of the second arched foot support slat between the lateral sidewall and the medial sidewall, and wherein the second arched foot support slat originates at or proximate to the lateral sidewall and the medial sidewall at locations spaced away from the lateral free edge and the medial free edge, a third arched foot support slat, wherein a local extrema of the third arched foot support slat is located in a central area of the third arched foot support slat between the lateral sidewall and the medial sidewall, and wherein the third arched foot support slat originates at or proximate to the lateral sidewall and the medial sidewall at locations spaced away from the lateral free edge and the medial free edge, a first open space extending between and separating at least 90% of a rearward edge of the first arched foot support slat from at least 90% of a forward edge of the second arched foot support slat, and a second open space extending between and separating at least 90% of a rearward edge the second arched foot support slat from at least 90% of a forward edge of the third arched foot support slat, wherein each of the first open space and the second open space constitutes a through hole extending completely through the base support surface from the exterior surface of the base support surface to the interior surface of the base support surface, wherein an interior surface of the lateral sidewall, an interior surface of the medial sidewall, and the interior surface of the base support surface define a receptacle, wherein the exterior surface of the base support surface includes a lateral base edge located on an opposite side of the lateral sidewall from the lateral free edge and a medial base edge located on an opposite side of the medial sidewall from the medial free edge;

a midsole component received in the receptacle; and a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

10. The foot support component according to claim 9, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

11. A foot support component for an article of footwear, comprising:

a lateral sidewall that extends to and forms a lateral free edge;

a medial sidewall located opposite the lateral sidewall, wherein the medial sidewall extends to and forms a medial free edge;

a base support surface that includes an exterior surface and an interior surface opposite the exterior surface, wherein the base support surface includes:

a first arched foot support member that includes: (a) a first forward edge extending between: (i) a first lateral origination point located at or proximate to the lateral sidewall and (ii) a first medial origination point located at or proximate to the medial sidewall and (b) a first rearward edge extending between: (i) a second lateral origination point located at or proximate to the lateral sidewall and (ii) a second medial origination point located at or proximate to the medial sidewall, and wherein the first arched foot support member includes a first single local extrema located in a central area of the first arched foot support member between the lateral sidewall and the medial sidewall, a second arched foot support member that includes: (a) a second forward edge extending between: (i) a third lateral origination point located at or proximate to the lateral sidewall and (ii) a third medial origination point located at or proximate to the medial sidewall and (b) a second rearward edge extending between: (i) a fourth lateral origination point located at or proximate to the lateral sidewall and (ii) a fourth medial origination point located at or proximate to the medial sidewall, and wherein the second arched foot support member includes a second single local extrema located in a central area of the second arched foot support member between the lateral sidewall and the medial sidewall, wherein the second forward edge is substantially parallel with the first rearward edge, and wherein the second forward edge is separated from the first rearward edge over at least 85% of a breadth dimension of the second arched foot support member, and a third arched foot support member that includes: (a) a third forward edge extending between: (i) a fifth lateral origination point located at or proximate to the lateral sidewall (ii) a fifth medial origination point located at or proximate to the medial sidewall and (b) a third rearward edge extending between: (i) a sixth lateral origination point located at or proximate to the lateral sidewall and (ii) a sixth medial origination point located at or proximate to the medial sidewall, and wherein the third arched foot support member includes a third single local extrema located in a central area of the third arched foot support member between the lateral sidewall and the medial sidewall, wherein the third forward edge is substantially parallel with the second rearward edge, and wherein the third forward edge is separated from the second rearward edge over at least 85% of a breadth dimension of the third arched foot support member; and a connecting wall connecting the lateral sidewall and the medial sidewall, wherein the connecting wall extends to and forms a connecting wall free edge that extends from the lateral free edge to the medial free edge.

12. The foot support component according to claim 11, wherein the connecting wall includes a notched or concave portion.

13. The foot support component according to claim 11, wherein an interior surface of the lateral sidewall, an interior surface of the medial sidewall, and the interior surface of the base support surface define a receptacle.

14. The foot support component according to claim 13, further comprising:

a midsole component received in the receptacle.

15. A foot support component for an article of footwear, comprising:

a lateral sidewall that extends to and forms a lateral free edge;

a medial sidewall located opposite the lateral sidewall, wherein the medial sidewall extends to and forms a medial free edge;

a base support surface that includes an exterior surface and an interior surface opposite the exterior surface, wherein the base support surface includes:

a first arched foot support member that includes: (a) a first forward edge extending between: (i) a first lateral origination point located at or proximate to the lateral sidewall and (ii) a first medial origination point located at or proximate to the medial sidewall and (b) a first rearward edge extending between: (i) a second lateral origination point located at or proximate to the lateral sidewall and (ii) a second medial origination point located at or proximate to the medial sidewall, and wherein the first arched foot support member includes a first single local extrema located in a central area of the first arched foot support member between the lateral sidewall and the medial sidewall, a second arched foot support member that includes: (a) a second forward edge extending between: (i) a third lateral origination point located at or proximate to the lateral sidewall and (ii) a third medial origination point located at or proximate to the medial sidewall and (b) a second rearward edge extending between: (i) a fourth lateral origination point located at or proximate to the lateral sidewall and (ii) a fourth medial origination point located at or proximate to the medial sidewall, and wherein the second arched foot support member includes a second single local extrema located in a central area of the second arched foot support member between the lateral sidewall and the medial sidewall, wherein the second forward edge is substantially parallel with the first rearward edge, and wherein the second forward edge is separated from the first rearward edge over at least 85% of a breadth dimension of the second arched foot support member, and a third arched foot support member that includes: (a) a third forward edge extending between: (i) a fifth lateral origination point located at or proximate to the lateral sidewall (ii) a fifth medial origination point located at or proximate to the medial sidewall and (b) a third rearward edge extending between: (i) a sixth lateral origination point located at or proximate to the lateral sidewall and (ii) a sixth medial origination point located at or proximate to the medial sidewall, and wherein the third arched foot support member includes a third single local extrema located in a central area of the third arched foot support member between the lateral sidewall and the medial sidewall, wherein the third forward edge is substantially parallel with the second rearward edge, and wherein the third forward edge is separated from the second rearward edge over at least 85% of a breadth dimension of the third arched foot support member, wherein an interior surface of the lateral sidewall, an interior surface of the medial sidewall, and the interior surface of the base support surface define a receptacle, wherein the exterior surface of the base support surface includes a lateral base edge located on an opposite side of the lateral sidewall from the lateral free edge and a medial base edge located on an opposite side of the medial sidewall from the medial free edge;

a midsole component received in the receptacle; and a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

16. The foot support component according to claim 15, wherein the lateral base edge of the first midsole system includes a first interlocking structure that engages with a first complementary interlocking structure provided on the lateral base edge of the base support surface, and wherein the medial base edge of the first midsole system includes a second interlocking structure that engages with a second complementary interlocking structure provided on the medial base edge of the base support surface.

17. A foot support component for an article of footwear, comprising:

a lateral sidewall that extends to and forms a lateral free edge;

a medial sidewall located opposite the lateral sidewall, wherein the medial sidewall extends to and forms a medial free edge;

a base support surface that includes an exterior surface and an interior surface opposite the exterior surface, wherein the base support surface includes:

a first foot support member that includes: (a) a first forward edge extending between: (i) a first lateral origination point located at or proximate to the lateral sidewall and (ii) a first medial origination point located at or proximate to the medial sidewall and (b) a first rearward edge extending between: (i) a second lateral origination point located at or proximate to the lateral sidewall and (ii) a second medial origination point located at or proximate to the medial sidewall, a second foot support member that includes: (a) a second forward edge extending between: (i) a third lateral origination point located at or proximate to the lateral sidewall and (ii) a third medial origination point located at or proximate to the medial sidewall and (b) a second rearward edge extending between: (i) a fourth lateral origination point located at or proximate to the lateral sidewall and (ii) a fourth medial origination point located at or proximate to the medial sidewall, and a third foot support member that includes: (a) a third forward edge extending between: (i) a fifth lateral origination point located at or proximate to the lateral sidewall and (ii) a fifth medial origination point located at or proximate to the medial sidewall and (b) a third rearward edge extending between: (i)

a sixth lateral origination point located at or proximate to the lateral sidewall and (ii) a sixth medial origination point located at or proximate to the medial sidewall; and a connecting wall connecting the lateral sidewall and the medial sidewall, wherein the connecting wall extends to and forms a connecting wall free edge that extends from the lateral free edge to the medial free edge.

18. The foot support component according to claim 17, wherein an interior surface of the lateral sidewall, an interior surface of the medial sidewall, and the interior surface of the base support surface define a receptacle, wherein the foot support component further comprises:

a midsole component received in the receptacle, and a first midsole system including a lateral base edge and a medial base edge, wherein the lateral base edge of the first midsole system is engaged with the lateral base edge of the base support surface, and wherein the medial base edge of the first midsole system is engaged with the medial base edge of the base support surface.

19. The foot support component according to claim 17, wherein an interior surface of the lateral sidewall, an interior surface of the medial sidewall, an interior surface of the connecting wall, and the interior surface of the base support surface define a receptacle, wherein the foot support component further comprises:

a midsole component received in the receptacle.

20. The foot support component according to claim 17, wherein the exterior surface of the base support surface includes a lateral base edge located on an opposite side of the lateral sidewall from the lateral free edge, a medial base edge located on an opposite side of the medial sidewall from the medial free edge, and a connecting base edge located on an opposite side of the connecting wall from the connecting wall free edge, and wherein the foot support component further comprises:

a first midsole system including a lateral base edge, a medial base edge, and a connecting base edge, wherein the lateral base edge of the first midsole system is engaged with the lateral base edge of the base support surface, wherein the medial base edge of the first midsole system is engaged with the medial base edge of the base support surface, wherein the connecting base edge of the first midsole system is engaged with the connecting base edge of the base support surface, and wherein the first midsole system has a U-shaped structure in which the lateral base edge of the first midsole system forms a lateral arm of the U-shaped structure, the medial base edge of the first midsole system forms a medial arm of the U-shaped structure, and the connecting base edge of the first midsole system forms a base of the U-shaped structure.

* * * * *